US011028677B1

(12) United States Patent
Yeung et al.

(10) Patent No.: US 11,028,677 B1
(45) Date of Patent: Jun. 8, 2021

(54) STAGE PROFILES FOR OPERATIONS OF HYDRAULIC SYSTEMS AND ASSOCIATED METHODS

(71) Applicant: BJ Energy Solutions, LLC, Houston, TX (US)

(72) Inventors: Tony Yeung, Tomball, TX (US); Ricardo Rodriguez-Ramon, Tomball, TX (US); Joseph Foster, Tomball, TX (US)

(73) Assignee: BJ Energy Solutions, LLC, Houston, TX (US)

( * ) Notice: Subject to any disclaimer, the term of this patent is extended or adjusted under 35 U.S.C. 154(b) by 0 days.

(21) Appl. No.: 17/182,489

(22) Filed: Feb. 23, 2021

Related U.S. Application Data

(60) Provisional application No. 62/705,356, filed on Jun. 23, 2020, provisional application No. 62/705,332, filed on Jun. 22, 2020.

(51) Int. Cl.
*E21B 43/26* (2006.01)
*E21B 43/267* (2006.01)
(Continued)

(52) U.S. Cl.
CPC ..... *E21B 43/26* (2013.01); *E21B 43/2607* (2020.05); *E21B 43/267* (2013.01);
(Continued)

(58) Field of Classification Search
CPC .... E21B 43/26; E21B 43/2607; E21B 43/267; E21B 49/008; E21B 2200/22; E21B 47/06
See application file for complete search history.

(56) References Cited

U.S. PATENT DOCUMENTS 2,498,229 A 2/1950 Adler
3,191,517 A 6/1965 Solzman
(Continued)

FOREIGN PATENT DOCUMENTS

CA 2876687 A1 5/2014
CA 2693567 9/2014
(Continued)

OTHER PUBLICATIONS

Europump and Hydrualic Institute, Variable Speed Pumping: A Guide to Successful Applications, Elsevier Ltd, 2004.
(Continued)

*Primary Examiner* — Brad Harcourt
(74) *Attorney, Agent, or Firm* — Womble Bond Dickinson (US) LLP

(57) ABSTRACT

A system and method of enhancing operation of hydraulic fracturing equipment at a hydraulic fracturing wellsite may include determining if a hydraulic fracturing stage profiles are available for use for hydraulic fracturing equipment at a wellsite. The method may include prompting an acceptance or amendment of one of the hydraulic fracturing stage profiles for a hydraulic fracturing pumping stage. The method may include, in response to an amendment of one of the hydraulic fracturing stage profiles, prompting acceptance of the amended hydraulic fracturing stage profile as the current hydraulic fracturing stage profile for use in association with the controller. The method may include, when a hydraulic fracturing stage profile is not available, prompting configuration of hydraulic fracturing pumping stage parameters for the current hydraulic fracturing stage profile. The method may include storing the current hydraulic fracturing stage profile as the previous hydraulic fracturing stage profile in association with the controller.

18 Claims, 11 Drawing Sheets

(51) Int. Cl.
*E21B 49/00* (2006.01)
*E21B 47/06* (2012.01)

(52) U.S. Cl.
CPC ..... *E21B 49/008* (2013.01); *E21B 47/06* (2013.01); *E21B 2200/22* (2020.05)

(56) References Cited

U.S. PATENT DOCUMENTS 3,257,031 A 6/1966 Dietz
3,378,074 A 4/1968 Kiel
3,739,872 A 6/1973 McNair
3,773,438 A 11/1973 Hall et al.
3,791,682 A 2/1974 Mitchell
3,796,045 A 3/1974 Foster
3,820,922 A 6/1974 Buse et al.
4,010,613 A 3/1977 McInerney
4,031,407 A 6/1977 Reed
4,086,976 A 5/1978 Holm et al.
4,222,229 A 9/1980 Uram
4,269,569 A 5/1981 Hoover
4,311,395 A 1/1982 Douthitt et al.
4,357,027 A 11/1982 Zeitlow
4,402,504 A 9/1983 Christian
4,457,325 A 7/1984 Green
4,470,771 A 9/1984 Hall et al.
4,574,880 A 3/1986 Handke
4,754,607 A 7/1988 Mackay
4,782,244 A 11/1988 Wakimoto
4,796,777 A 1/1989 Keller
4,913,625 A 4/1990 Gerlowski
4,983,259 A 1/1991 Duncan
4,990,058 A 2/1991 Eslinger
5,537,813 A 7/1996 Davis et al.
5,553,514 A 9/1996 Walkowc
5,560,195 A 10/1996 Anderson et al.
5,622,245 A 4/1997 Reik
5,651,400 A 7/1997 Corts et al.
5,678,460 A 10/1997 Walkowc
5,717,172 A 2/1998 Griffin, Jr. et al.
5,983,962 A 11/1999 Gerardot
6,041,856 A 3/2000 Thrasher et al.
6,050,080 A 4/2000 Horner
6,071,188 A 6/2000 O'Neill et al.
6,123,751 A 9/2000 Nelson et al.
6,129,335 A 10/2000 Yokogi
6,145,318 A 11/2000 Kaplan et al.
6,279,309 B1 8/2001 Lawlor, II et al.
6,321,860 B1 11/2001 Reddoch
6,334,746 B1 1/2002 Nguyen et al.
6,530,224 B1 3/2003 Conchieri
6,543,395 B2 4/2003 Green
6,655,922 B1 12/2003 Flek
6,765,304 B2 7/2004 Baten et al.
6,786,051 B2 9/2004 Kristich et al.
6,851,514 B2 2/2005 Han et al.
6,859,740 B2 2/2005 Stephenson et al.
6,901,735 B2 6/2005 Lohn
7,065,953 B1 6/2006 Kopko
7,222,015 B2 5/2007 Davis et al.
7,388,303 B2 6/2008 Seiver
7,545,130 B2 6/2009 Latham
7,552,903 B2 6/2009 Dunn et al.
7,563,076 B2 7/2009 Brunet et al.
7,627,416 B2 12/2009 Batenburg et al.
7,677,316 B2 3/2010 Butler et al.
7,721,521 B2 5/2010 Kunkle et al.
7,730,711 B2 6/2010 Kunkle et al.
7,845,413 B2 12/2010 Shampine et al.
7,900,724 B2 3/2011 Promersberger et al.
7,921,914 B2 4/2011 Bruins et al.
7,938,151 B2 5/2011 Höckner
7,980,357 B2 7/2011 Edwards
8,083,504 B2 12/2011 Williams et al.
8,186,334 B2 5/2012 Ooyama
8,196,555 B2 6/2012 Ikeda et al.
8,316,936 B2 11/2012 Roddy et al.
8,414,673 B2 4/2013 Raje et al.
8,506,267 B2 8/2013 Gambier et al.
8,575,873 B2 11/2013 Peterson et al.
8,616,005 B1 12/2013 Cousino, Sr. et al.
8,621,873 B2 1/2014 Robertson et al.
8,672,606 B2 3/2014 Glynn et al.
8,714,253 B2 5/2014 Sherwood et al.
8,770,329 B2 7/2014 Spitler
8,789,601 B2 7/2014 Broussard et al.
8,794,307 B2 8/2014 Coquilleau et al.
8,801,394 B2 8/2014 Anderson
8,851,441 B2 10/2014 Acuna et al.
8,905,056 B2 12/2014 Kendrick
8,973,560 B2 3/2015 Krug
8,997,904 B2 4/2015 Cryer et al.
9,032,620 B2 5/2015 Frassinelli et al.
9,057,247 B2 6/2015 Kumar et al.
9,103,193 B2 8/2015 Coli et al.
9,121,257 B2 9/2015 Coli et al.
9,140,110 B2 9/2015 Coli et al.
9,187,982 B2 11/2015 Dehring et al.
9,212,643 B2 12/2015 Deliyski
9,341,055 B2 5/2016 Weightman et al.
9,346,662 B2 5/2016 Van Vliet et al.
9,366,114 B2 6/2016 Coli et al.
9,376,786 B2 6/2016 Numasawa
9,394,829 B2 7/2016 Cabeen et al.
9,395,049 B2 7/2016 Vicknair et al.
9,401,670 B2 7/2016 Minato et al.
9,410,410 B2 8/2016 Broussard et al.
9,410,546 B2 8/2016 Jaeger et al.
9,429,078 B1 8/2016 Crowe et al.
9,493,997 B2 11/2016 Liu et al.
9,512,783 B2 12/2016 Veilleux et al.
9,534,473 B2 1/2017 Morris et al.
9,546,652 B2 1/2017 Yin
9,550,501 B2 1/2017 Ledbetter
9,556,721 B2 1/2017 Jang et al.
9,562,420 B2 2/2017 Morris et al.
9,570,945 B2 2/2017 Fischer
9,579,980 B2 2/2017 Cryer et al.
9,587,649 B2 3/2017 Oehring
9,611,728 B2 4/2017 Oehring
9,617,808 B2 4/2017 Liu et al.
9,638,101 B1 5/2017 Crowe et al.
9,638,194 B2 5/2017 Wiegman et al.
9,650,871 B2 5/2017 Oehring et al.
9,656,762 B2 5/2017 Kamath et al.
9,689,316 B1 6/2017 Crom
9,739,130 B2 8/2017 Young
9,764,266 B1 9/2017 Carter
9,777,748 B2 10/2017 Lu et al.
9,803,467 B2 10/2017 Tang et al.
9,803,793 B2 10/2017 Davi et al.
9,809,308 B2 11/2017 Aguilar et al.
9,829,002 B2 11/2017 Crom
9,840,897 B2 12/2017 Larson
9,840,901 B2 12/2017 Oering et al.
9,850,422 B2 12/2017 Lestz et al.
9,856,131 B1 1/2018 Moffitt
9,863,279 B2 1/2018 Laing et al.
9,869,305 B1 1/2018 Crowe et al.
9,879,609 B1 1/2018 Crowe et al.
9,893,500 B2 2/2018 Oehring et al.
9,893,660 B2 2/2018 Peterson et al.
9,920,615 B2 3/2018 Zhang et al.
9,945,365 B2 4/2018 Hernandez et al.
9,964,052 B2 5/2018 Millican et al.
9,970,278 B2 5/2018 Broussard et al.
9,981,840 B2 5/2018 Shock
9,995,102 B2 6/2018 Dillie et al.
9,995,218 B2 6/2018 Oehring et al.
10,008,880 B2 6/2018 Vicknair et al.
10,018,096 B2 7/2018 Wallimann et al.
10,020,711 B2 7/2018 Oehring et al.
10,029,289 B2 7/2018 Wendorski et al.
10,030,579 B2 7/2018 Austin et al.
10,036,238 B2 7/2018 Oehring

(56) References Cited

U.S. PATENT DOCUMENTS 10,040,541 B2 8/2018 Wilson et al.
10,060,349 B2 8/2018 Álvarez et al.
10,082,137 B2 9/2018 Graham et al.
10,100,827 B2 10/2018 Devan et al.
10,107,084 B2 10/2018 Coli et al.
10,107,085 B2 10/2018 Coli et al.
10,114,061 B2 10/2018 Frampton et al.
10,119,381 B2 11/2018 Oehring et al.
10,134,257 B2 11/2018 Zhang et al.
10,151,244 B2 12/2018 Giancotti et al.
10,174,599 B2 1/2019 Shampine et al.
10,184,397 B2 1/2019 Austin et al.
10,196,258 B2 2/2019 Kalala et al.
10,221,856 B2 3/2019 Hernandez et al.
10,227,854 B2 3/2019 Glass
10,227,855 B2 3/2019 Coli et al.
10,246,984 B2 4/2019 Payne et al.
10,247,182 B2 4/2019 Zhang et al.
10,254,732 B2 4/2019 Oehring et al.
10,267,439 B2 4/2019 Pryce et al.
10,280,724 B2 5/2019 Hinderliter
10,287,943 B1 5/2019 Schiltz
10,303,190 B2 5/2019 Shock
10,316,832 B2 6/2019 Byrne
10,317,875 B2 6/2019 Pandurangan
10,337,402 B2 7/2019 Austin et al.
10,358,035 B2 7/2019 Cryer
10,371,012 B2 8/2019 Davis et al.
10,374,485 B2 8/2019 Morris et al.
10,378,326 B2 8/2019 Morris et al.
10,393,108 B2 8/2019 Chong et al.
10,407,990 B2 9/2019 Oehring et al.
10,408,031 B2 9/2019 Oehring et al.
10,415,348 B2 9/2019 Zhang et al.
10,415,557 B1 9/2019 Crowe et al.
10,415,562 B2 9/2019 Kajita et al.
RE47,695 E 11/2019 Case et al.
10,465,689 B2 11/2019 Crom
10,526,882 B2 1/2020 Oehring et al.
10,563,649 B2 2/2020 Zhang et al.
10,577,910 B2 3/2020 Stephenson
10,598,258 B2 3/2020 Oehring et al.
10,610,842 B2 4/2020 Chong
10,655,442 B2 * 5/2020 Lecerf ..... E21B 43/25
10,711,787 B1 7/2020 Darley
10,738,580 B1 8/2020 Fischer et al.
10,753,153 B1 8/2020 Fischer et al.
10,753,165 B1 8/2020 Fischer et al.
10,794,165 B2 10/2020 Fischer et al.
10,794,166 B2 10/2020 Reckels et al.
10,801,311 B1 10/2020 Cui et al.
10,815,764 B1 10/2020 Yeung et al.
10,815,978 B2 10/2020 Glass
10,830,032 B1 11/2020 Zhang et al.
10,865,624 B1 12/2020 Cui et al.
10,865,631 B1 12/2020 Zhang et al.
10,895,202 B1 1/2021 Yeung et al.
10,907,459 B1 2/2021 Yeung et al.
10,954,770 B1 3/2021 Yeung et al.
10,961,908 B1 3/2021 Yeung et al.
10,961,912 B1 3/2021 Yeung et al.
10,961,914 B1 3/2021 Yeung et al.
2004/0016245 A1 1/2004 Pierson
2004/0187950 A1 9/2004 Cohen et al.
2005/0139286 A1 6/2005 Poulter
2005/0226754 A1 10/2005 Orr et al.
2006/0061091 A1 3/2006 Osterloh
2006/0260331 A1 11/2006 Andreychuk
2007/0029090 A1 2/2007 Andreychuk et al.
2007/0066406 A1 3/2007 Keller et al.
2007/0107981 A1 5/2007 Sicotte
2007/0181212 A1 8/2007 Fell
2007/0277982 A1 12/2007 Shampine et al.
2007/0295569 A1 12/2007 Manzoor et al.
2008/0098891 A1 5/2008 Feher
2008/0161974 A1 7/2008 Alston
2008/0264625 A1 10/2008 Ochoa
2008/0264649 A1 10/2008 Crawford
2009/0064685 A1 3/2009 Busekros et al.
2009/0124191 A1 5/2009 Van Becelaere et al.
2010/0071899 A1 3/2010 Coquilleau et al.
2010/0218508 A1 9/2010 Brown et al.
2010/0300683 A1 12/2010 Looper et al.
2010/0310384 A1 12/2010 Stephenson et al.
2011/0052423 A1 3/2011 Gambier et al.
2011/0054704 A1 3/2011 Karpman et al.
2011/0085924 A1 4/2011 Shampine et al.
2011/0197988 A1 8/2011 Van Vliet et al.
2011/0241888 A1 10/2011 Lu et al.
2011/0265443 A1 11/2011 Ansari
2011/0272158 A1 11/2011 Neal
2012/0048242 A1 3/2012 Surnilla et al.
2012/0179444 A1 * 7/2012 Ganguly ..... E21B 43/26 703/10
2012/0199001 A1 8/2012 Chillar et al.
2012/0310509 A1 12/2012 Pardo et al.
2013/0068307 A1 3/2013 Hains et al.
2013/0087045 A1 4/2013 Sullivan et al.
2013/0087945 A1 4/2013 Kusters et al.
2013/0284455 A1 10/2013 Kajaria et al.
2013/0300341 A1 11/2013 Gillette
2013/0306322 A1 11/2013 Sanborn
2014/0013768 A1 1/2014 Laing et al.
2014/0044517 A1 2/2014 Saha et al.
2014/0048253 A1 2/2014 Andreychuk
2014/0090742 A1 4/2014 Coskrey et al.
2014/0130422 A1 5/2014 Laing et al.
2014/0147291 A1 5/2014 Burnette
2014/0277772 A1 9/2014 Lopez et al.
2014/0290266 A1 10/2014 Veilleux, Jr. et al.
2014/0318638 A1 10/2014 Harwood et al.
2015/0078924 A1 3/2015 Zhang et al.
2015/0101344 A1 4/2015 Jarrier et al.
2015/0114652 A1 4/2015 Lestz et al.
2015/0135659 A1 5/2015 Jarrier et al.
2015/0159553 A1 6/2015 Kippel et al.
2015/0192117 A1 7/2015 Bridges
2015/0204148 A1 7/2015 Liu et al.
2015/0204322 A1 7/2015 Iund et al.
2015/0211512 A1 7/2015 Wiegman et al.
2015/0217672 A1 8/2015 Shampine et al.
2015/0275891 A1 10/2015 Chong et al.
2015/0369351 A1 12/2015 Hermann et al.
2016/0032703 A1 2/2016 Broussard et al.
2016/0102581 A1 4/2016 Del Bono
2016/0105022 A1 4/2016 Oehring et al.
2016/0108713 A1 4/2016 Dunaeva et al.
2016/0177675 A1 6/2016 Morris et al.
2016/0186671 A1 6/2016 Austin et al.
2016/0215774 A1 7/2016 Oklejas et al.
2016/0230525 A1 8/2016 Lestz et al.
2016/0244314 A1 8/2016 Van Vliet et al.
2016/0248230 A1 8/2016 Tawy et al.
2016/0253634 A1 9/2016 Thomeer et al.
2016/0273346 A1 9/2016 Tang et al.
2016/0290114 A1 10/2016 Oehring et al.
2016/0319650 A1 11/2016 Oehring et al.
2016/0326845 A1 * 11/2016 Djikpesse ..... G06Q 50/02
2016/0348479 A1 12/2016 Oehring et al.
2016/0369609 A1 12/2016 Morris et al.
2017/0009905 A1 1/2017 Arnold
2017/0016433 A1 1/2017 Chong et al.
2017/0030177 A1 2/2017 Oehring et al.
2017/0038137 A1 2/2017 Turney
2017/0074076 A1 3/2017 Joseph et al.
2017/0082110 A1 3/2017 Lammers
2017/0089189 A1 3/2017 Norris et al.
2017/0145918 A1 5/2017 Oehring et al.
2017/0218727 A1 8/2017 Oehring et al.
2017/0226839 A1 8/2017 Broussard et al.
2017/0227002 A1 8/2017 Mikulski et al.
2017/0234165 A1 8/2017 Kersey et al.
2017/0234308 A1 8/2017 Buckley
2017/0248034 A1 8/2017 Dzieciol et al.

(56) References Cited

U.S. PATENT DOCUMENTS

2017/0275149 A1 9/2017 Schmidt
2017/0292409 A1 10/2017 Aguilar et al.
2017/0302135 A1 10/2017 Cory
2017/0305736 A1 10/2017 Haile et al.
2017/0334448 A1 11/2017 Schwunk
2017/0350471 A1 12/2017 Steidl et al.
2017/0370199 A1 12/2017 Witkowski et al.
2018/0034280 A1 2/2018 Pedersen
2018/0038328 A1 2/2018 Louven et al.
2018/0041093 A1 2/2018 Miranda
2018/0045202 A1 2/2018 Crom
2018/0038216 A1 3/2018 Zhang et al.
2018/0058171 A1 3/2018 Roesner et al.
2018/0156210 A1 6/2018 Oehring et al.
2018/0172294 A1 6/2018 Owen
2018/0183219 A1 6/2018 Oehring et al.
2018/0186442 A1 7/2018 Maier
2018/0187662 A1 7/2018 Hill et al.
2018/0223640 A1 8/2018 Keihany et al.
2018/0224044 A1 8/2018 Penney
2018/0229998 A1 8/2018 Shock
2018/0258746 A1 9/2018 Broussard et al.
2018/0266412 A1 9/2018 Stokkevag et al.
2018/0278124 A1 9/2018 Oehring et al.
2018/0283102 A1 10/2018 Cook
2018/0283618 A1 10/2018 Cook
2018/0284817 A1 10/2018 Cook et al.
2018/0291781 A1 10/2018 Pedrini
2018/0298731 A1 10/2018 Bishop
2018/0298735 A1 10/2018 Conrad
2018/0307255 A1 10/2018 Bishop
2018/0328157 A1 11/2018 Bishop
2018/0334893 A1 11/2018 Oehring
2018/0363435 A1 12/2018 Coli et al.
2018/0363436 A1 12/2018 Coli et al.
2018/0363437 A1 12/2018 Coli et al.
2018/0363438 A1 12/2018 Coli et al.
2019/0003272 A1 1/2019 Morris et al.
2019/0003329 A1 1/2019 Morris et al.
2019/0010793 A1 1/2019 Hinderliter
2019/0063341 A1 2/2019 Davis
2019/0067991 A1 2/2019 Davis et al.
2019/0071992 A1 3/2019 Feng
2019/0072005 A1 3/2019 Fisher et al.
2019/0078471 A1 3/2019 Braglia et al.
2019/0091619 A1 3/2019 Huang
2019/0106316 A1 4/2019 Van Vliet et al.
2019/0106970 A1 4/2019 Oehring
2019/0112908 A1 4/2019 Coli et al.
2019/0112910 A1 4/2019 Oehring et al.
2019/0119096 A1 4/2019 Haile et al.
2019/0120024 A1 4/2019 Oehring et al.
2019/0120031 A1 4/2019 Gilje
2019/0120134 A1 4/2019 Goleczka et al.
2019/0128247 A1 5/2019 Douglas, III
2019/0131607 A1 5/2019 Gillette
2019/0136677 A1 5/2019 Shampine et al.
2019/0153843 A1 5/2019 Headrick et al.
2019/0154020 A1 5/2019 Glass
2019/0264667 A1 5/2019 Byrne
2019/0178234 A1 6/2019 Beisel
2019/0178235 A1 6/2019 Coskrey et al.
2019/0185312 A1 6/2019 Bush et al.
2019/0203572 A1 7/2019 Morris et al.
2019/0204021 A1 7/2019 Morris et al.
2019/0217258 A1 7/2019 Bishop
2019/0226317 A1 7/2019 Payne et al.
2019/0245348 A1 8/2019 Hinderliter et al.
2019/0249652 A1 8/2019 Stephenson et al.
2019/0249754 A1 8/2019 Oehring et al.
2019/0257297 A1 8/2019 Botting et al.
2019/0277295 A1 9/2019 Clyburn et al.
2019/0316447 A1 10/2019 Oehring et al.
2019/0316456 A1 10/2019 Beisel et al.
2019/0323337 A1 10/2019 Glass et al.
2019/0330923 A1 10/2019 Gable et al.
2019/0331117 A1 10/2019 Gable et al.
2019/0338762 A1 11/2019 Curry et al.
2019/0345920 A1 11/2019 Surjaatmadja et al.
2019/0356199 A1 11/2019 Morris et al.
2020/0003205 A1 1/2020 Stokkevåg et al.
2020/0040878 A1 2/2020 Morris
2020/0049136 A1 2/2020 Stephenson
2020/0049153 A1 2/2020 Headrick et al.
2020/0071998 A1 3/2020 Oehring et al.
2020/0088202 A1 3/2020 Sigmar et al.
2020/0095854 A1 3/2020 Hinderliter
2020/0132058 A1 4/2020 Mollatt
2020/0141219 A1 5/2020 Oehring et al.
2020/0141907 A1 5/2020 Meck et al.
2020/0166026 A1 5/2020 Marica
2020/0206704 A1 7/2020 Chong
2020/0224645 A1 7/2020 Buckley
2020/0256333 A1 8/2020 Surjaatmadja
2020/0263498 A1 8/2020 Fischer et al.
2020/0263525 A1 8/2020 Reid
2020/0263526 A1 8/2020 Fischer et al.
2020/0263527 A1 8/2020 Fischer et al.
2020/0263528 A1 8/2020 Fischer et al.
2020/0267888 A1 8/2020 Putz
2020/0309113 A1 10/2020 Hunter et al.
2020/0325752 A1 10/2020 Clark et al.
2020/0325760 A1 10/2020 Markham
2020/0325761 A1 10/2020 Williams
2020/0332784 A1 10/2020 Zhang et al.
2020/0332788 A1 10/2020 Cui et al.
2020/0340313 A1 10/2020 Fischer et al.
2020/0340340 A1 10/2020 Oehring et al.
2020/0340344 A1 10/2020 Reckels et al.
2020/0340404 A1 10/2020 Stockstill
2020/0347725 A1 11/2020 Morris et al.
2020/0392826 A1 12/2020 Cui et al.
2020/0398238 A1 12/2020 Zhong et al.
2020/0400000 A1 12/2020 Ghasripoor et al.
2020/0400005 A1 12/2020 Han et al.
2020/0408071 A1 12/2020 Li et al.
2020/0408144 A1 12/2020 Feng et al.
2020/0408147 A1 12/2020 Zhang et al.
2021/0071574 A1 3/2021 Feng et al.
2021/0071579 A1 3/2021 Li et al.
2021/0071752 A1 3/2021 Cui et al.
2021/0087925 A1* 3/2021 Heidari ..... E21B 47/12

FOREIGN PATENT DOCUMENTS

CA 2876687 C 4/2019
CN 2779054 5/2006
CN 2890325 4/2007
CN 200964929 Y 10/2007
CN 101323151 A 12/2008
CN 201190660 Y 2/2009
CN 201190892 Y 2/2009
CN 201190893 Y 2/2009
CN 101414171 A 4/2009
CN 201215073 Y 4/2009
CN 201236650 Y 5/2009
CN 201275542 Y 7/2009
CN 201275801 Y 7/2009
CN 201333385 Y 10/2009
CN 201443300 U 4/2010
CN 201496415 U 6/2010
CN 201501365 U 6/2010
CN 201507271 U 6/2010
CN 101323151 B 7/2010
CN 201560210 U 8/2010
CN 201581862 U 9/2010
CN 201610728 U 10/2010
CN 201610751 U 10/2010
CN 201618530 U 11/2010
CN 201661255 U 12/2010
CN 101949382 1/2011
CN 201756927 U 3/2011
CN 101414171 B 5/2011
CN 102128011 A 7/2011

(56) References Cited

FOREIGN PATENT DOCUMENTS

| | | | |
|---|---|---|---|
| CN | 102140898 | A | 8/2011 |
| CN | 102155172 | A | 8/2011 |
| CN | 202000930 | U | 10/2011 |
| CN | 202055781 | U | 11/2011 |
| CN | 202082265 | U | 12/2011 |
| CN | 202100216 | U | 1/2012 |
| CN | 202100217 | U | 1/2012 |
| CN | 202100815 | U | 1/2012 |
| CN | 202124340 | U | 1/2012 |
| CN | 202140051 | U | 2/2012 |
| CN | 202140080 | U | 2/2012 |
| CN | 202144789 | U | 2/2012 |
| CN | 202144943 | U | 2/2012 |
| CN | 202149354 | U | 2/2012 |
| CN | 102383748 | A | 3/2012 |
| CN | 202156297 | U | 3/2012 |
| CN | 202158355 | U | 3/2012 |
| CN | 202163504 | U | 3/2012 |
| CN | 202165236 | U | 3/2012 |
| CN | 202180866 | U | 4/2012 |
| CN | 202181875 | U | 4/2012 |
| CN | 202187744 | U | 4/2012 |
| CN | 202191854 | U | 4/2012 |
| CN | 202250008 | U | 5/2012 |
| CN | 101885307 | | 7/2012 |
| CN | 102562020 | A | 7/2012 |
| CN | 202326156 | U | 7/2012 |
| CN | 202370773 | U | 8/2012 |
| CN | 202417397 | U | 9/2012 |
| CN | 202417461 | U | 9/2012 |
| CN | 102729335 | A | 10/2012 |
| CN | 202463955 | U | 10/2012 |
| CN | 202463957 | U | 10/2012 |
| CN | 202467739 | U | 10/2012 |
| CN | 202467801 | U | 10/2012 |
| CN | 202531016 | U | 11/2012 |
| CN | 202544794 | U | 11/2012 |
| CN | 102825039 | A | 12/2012 |
| CN | 202578592 | U | 12/2012 |
| CN | 202579164 | U | 12/2012 |
| CN | 202594808 | U | 12/2012 |
| CN | 202594928 | U | 12/2012 |
| CN | 202596615 | U | 12/2012 |
| CN | 202596616 | U | 12/2012 |
| CN | 102849880 | A | 1/2013 |
| CN | 102889191 | A | 1/2013 |
| CN | 202641535 | U | 1/2013 |
| CN | 202645475 | U | 1/2013 |
| CN | 202666716 | U | 1/2013 |
| CN | 202669645 | U | 1/2013 |
| CN | 202669944 | U | 1/2013 |
| CN | 202671336 | U | 1/2013 |
| CN | 202673269 | U | 1/2013 |
| CN | 202751982 | U | 2/2013 |
| CN | 102963629 | A | 3/2013 |
| CN | 202767964 | U | 3/2013 |
| CN | 202789791 | U | 3/2013 |
| CN | 202789792 | U | 3/2013 |
| CN | 202810717 | U | 3/2013 |
| CN | 202827276 | U | 3/2013 |
| CN | 202833093 | U | 3/2013 |
| CN | 202833370 | U | 3/2013 |
| CN | 102140898 | B | 4/2013 |
| CN | 202895467 | U | 4/2013 |
| CN | 202935798 | U | 5/2013 |
| CN | 202935816 | U | 5/2013 |
| CN | 202970631 | U | 6/2013 |
| CN | 103223315 | A | 7/2013 |
| CN | 203050598 | U | 7/2013 |
| CN | 103233714 | A | 8/2013 |
| CN | 103233715 | A | 8/2013 |
| CN | 103245523 | A | 8/2013 |
| CN | 103247220 | A | 8/2013 |
| CN | 103253839 | A | 8/2013 |
| CN | 103277290 | A | 9/2013 |
| CN | 103321782 | A | 9/2013 |
| CN | 203170270 | U | 9/2013 |
| CN | 203172509 | U | 9/2013 |
| CN | 203175778 | U | 9/2013 |
| CN | 203175787 | U | 9/2013 |
| CN | 102849880 | B | 10/2013 |
| CN | 203241231 | U | 10/2013 |
| CN | 203244941 | U | 10/2013 |
| CN | 203244942 | U | 10/2013 |
| CN | 203303798 | U | 11/2013 |
| CN | 102155172 | B | 12/2013 |
| CN | 102729335 | B | 12/2013 |
| CN | 103420532 | A | 12/2013 |
| CN | 203321792 | U | 12/2013 |
| CN | 203412658 | | 1/2014 |
| CN | 203420697 | U | 2/2014 |
| CN | 203480755 | U | 3/2014 |
| CN | 103711437 | A | 4/2014 |
| CN | 203531815 | U | 4/2014 |
| CN | 203531871 | U | 4/2014 |
| CN | 203531883 | U | 4/2014 |
| CN | 203556164 | U | 4/2014 |
| CN | 203558809 | U | 4/2014 |
| CN | 203559861 | U | 4/2014 |
| CN | 203559893 | U | 4/2014 |
| CN | 203560189 | U | 4/2014 |
| CN | 102704870 | B | 5/2014 |
| CN | 203611843 | U | 5/2014 |
| CN | 203612531 | U | 5/2014 |
| CN | 203612843 | U | 5/2014 |
| CN | 203614062 | U | 5/2014 |
| CN | 203614388 | U | 5/2014 |
| CN | 203621045 | U | 6/2014 |
| CN | 203621046 | U | 6/2014 |
| CN | 203621051 | U | 6/2014 |
| CN | 203640993 | U | 6/2014 |
| CN | 203655221 | U | 6/2014 |
| CN | 103899280 | A | 7/2014 |
| CN | 103923670 | A | 7/2014 |
| CN | 203685052 | U | 7/2014 |
| CN | 203716936 | U | 7/2014 |
| CN | 103990410 | A | 8/2014 |
| CN | 103993869 | A | 8/2014 |
| CN | 203754009 | U | 8/2014 |
| CN | 203754025 | U | 8/2014 |
| CN | 203754341 | U | 8/2014 |
| CN | 203756614 | U | 8/2014 |
| CN | 203770264 | U | 8/2014 |
| CN | 203784519 | U | 8/2014 |
| CN | 203784520 | U | 8/2014 |
| CN | 104057864 | A | 9/2014 |
| CN | 203819819 | U | 9/2014 |
| CN | 203823431 | U | 9/2014 |
| CN | 203835337 | U | 9/2014 |
| CN | 104074500 | A | 10/2014 |
| CN | 203876633 | U | 10/2014 |
| CN | 203876636 | U | 10/2014 |
| CN | 203877364 | U | 10/2014 |
| CN | 203877365 | U | 10/2014 |
| CN | 203877375 | U | 10/2014 |
| CN | 203877424 | U | 10/2014 |
| CN | 203879476 | U | 10/2014 |
| CN | 203879479 | U | 10/2014 |
| CN | 203890292 | U | 10/2014 |
| CN | 203899476 | U | 10/2014 |
| CN | 203906206 | U | 10/2014 |
| CN | 104150728 | A | 11/2014 |
| CN | 104176522 | A | 12/2014 |
| CN | 104196464 | A | 12/2014 |
| CN | 104234651 | A | 12/2014 |
| CN | 203971841 | U | 12/2014 |
| CN | 203975450 | U | 12/2014 |
| CN | 204020788 | U | 12/2014 |
| CN | 204021980 | U | 12/2014 |
| CN | 204024625 | U | 12/2014 |
| CN | 204051401 | U | 12/2014 |
| CN | 204060661 | U | 12/2014 |
| CN | 104260672 | A | 1/2015 |
| CN | 104314512 | A | 1/2015 |

(56) References Cited

FOREIGN PATENT DOCUMENTS

| | | | |
|---|---|---|---|
| CN | 204077478 | U | 1/2015 |
| CN | 204077526 | U | 1/2015 |
| CN | 204078307 | U | 1/2015 |
| CN | 204083051 | U | 1/2015 |
| CN | 204113168 | U | 1/2015 |
| CN | 104340682 | A | 2/2015 |
| CN | 104358536 | A | 2/2015 |
| CN | 104369687 | A | 2/2015 |
| CN | 104402178 | A | 3/2015 |
| CN | 104402185 | A | 3/2015 |
| CN | 104402186 | A | 3/2015 |
| CN | 204209819 | U | 3/2015 |
| CN | 204224560 | U | 3/2015 |
| CN | 204225813 | U | 3/2015 |
| CN | 204225839 | U | 3/2015 |
| CN | 104533392 | A | 4/2015 |
| CN | 104563938 | A | 4/2015 |
| CN | 104563994 | A | 4/2015 |
| CN | 104563995 | A | 4/2015 |
| CN | 104563998 | A | 4/2015 |
| CN | 104564033 | A | 4/2015 |
| CN | 204257122 | U | 4/2015 |
| CN | 204283610 | U | 4/2015 |
| CN | 204283782 | U | 4/2015 |
| CN | 204297682 | U | 4/2015 |
| CN | 204299810 | U | 4/2015 |
| CN | 103223315 | B | 5/2015 |
| CN | 104594857 | A | 5/2015 |
| CN | 104595493 | A | 5/2015 |
| CN | 104612647 | A | 5/2015 |
| CN | 104612928 | A | 5/2015 |
| CN | 104632126 | A | 5/2015 |
| CN | 204325094 | U | 5/2015 |
| CN | 204325098 | U | 5/2015 |
| CN | 204326983 | U | 5/2015 |
| CN | 204326985 | U | 5/2015 |
| CN | 204344040 | U | 5/2015 |
| CN | 204344095 | U | 5/2015 |
| CN | 104727797 | A | 6/2015 |
| CN | 204402414 | U | 6/2015 |
| CN | 204402423 | U | 6/2015 |
| CN | 204402450 | U | 6/2015 |
| CN | 103247220 | B | 7/2015 |
| CN | 104803568 | A | 7/2015 |
| CN | 204436360 | U | 7/2015 |
| CN | 204457524 | U | 7/2015 |
| CN | 204472485 | U | 7/2015 |
| CN | 204473625 | U | 7/2015 |
| CN | 204477303 | U | 7/2015 |
| CN | 204493095 | U | 7/2015 |
| CN | 204493309 | U | 7/2015 |
| CN | 103253839 | B | 8/2015 |
| CN | 104820372 | A | 8/2015 |
| CN | 104832093 | A | 8/2015 |
| CN | 104863523 | A | 8/2015 |
| CN | 204552723 | U | 8/2015 |
| CN | 204553866 | U | 8/2015 |
| CN | 204571831 | U | 8/2015 |
| CN | 204703814 | U | 10/2015 |
| CN | 204703833 | U | 10/2015 |
| CN | 204703834 | U | 10/2015 |
| CN | 105092401 | A | 11/2015 |
| CN | 103233715 | B | 12/2015 |
| CN | 103790927 | | 12/2015 |
| CN | 105207097 | | 12/2015 |
| CN | 204831952 | U | 12/2015 |
| CN | 204899777 | U | 12/2015 |
| CN | 102602323 | | 1/2016 |
| CN | 105240064 | A | 1/2016 |
| CN | 204944834 | | 1/2016 |
| CN | 205042127 | U | 2/2016 |
| CN | 205172478 | U | 4/2016 |
| CN | 103993869 | B | 5/2016 |
| CN | 105536299 | A | 5/2016 |
| CN | 105545207 | A | 5/2016 |
| CN | 205260249 | | 5/2016 |
| CN | 103233714 | B | 6/2016 |
| CN | 104340682 | B | 6/2016 |
| CN | 205297518 | U | 6/2016 |
| CN | 205298447 | U | 6/2016 |
| CN | 205391821 | U | 7/2016 |
| CN | 205400701 | U | 7/2016 |
| CN | 103277290 | B | 8/2016 |
| CN | 104260672 | B | 8/2016 |
| CN | 205477370 | U | 8/2016 |
| CN | 205479153 | U | 8/2016 |
| CN | 205503058 | U | 8/2016 |
| CN | 205503068 | U | 8/2016 |
| CN | 205503089 | U | 8/2016 |
| CN | 105958098 | A | 9/2016 |
| CN | 205599180 | | 9/2016 |
| CN | 205599180 | U | 9/2016 |
| CN | 106121577 | A | 11/2016 |
| CN | 205709587 | | 11/2016 |
| CN | 104612928 | B | 12/2016 |
| CN | 106246120 | A | 12/2016 |
| CN | 205805471 | | 12/2016 |
| CN | 106321045 | A | 1/2017 |
| CN | 205858306 | | 1/2017 |
| CN | 106438310 | A | 2/2017 |
| CN | 205937833 | | 2/2017 |
| CN | 104563994 | B | 3/2017 |
| CN | 206129196 | | 4/2017 |
| CN | 104369687 | B | 5/2017 |
| CN | 106715165 | | 5/2017 |
| CN | 106761561 | A | 5/2017 |
| CN | 105240064 | B | 6/2017 |
| CN | 206237147 | | 6/2017 |
| CN | 206287832 | | 6/2017 |
| CN | 206346711 | | 7/2017 |
| CN | 104563995 | B | 9/2017 |
| CN | 107120822 | | 9/2017 |
| CN | 107143298 | A | 9/2017 |
| CN | 107159046 | A | 9/2017 |
| CN | 107188018 | A | 9/2017 |
| CN | 206496016 | | 9/2017 |
| CN | 104564033 | B | 10/2017 |
| CN | 107234358 | A | 10/2017 |
| CN | 107261975 | A | 10/2017 |
| CN | 206581929 | | 10/2017 |
| CN | 104820372 | B | 12/2017 |
| CN | 105092401 | B | 12/2017 |
| CN | 107476769 | A | 12/2017 |
| CN | 107520526 | A | 12/2017 |
| CN | 206754664 | | 12/2017 |
| CN | 107605427 | A | 1/2018 |
| CN | 106438310 | B | 2/2018 |
| CN | 107654196 | A | 2/2018 |
| CN | 107656499 | A | 2/2018 |
| CN | 107728657 | A | 2/2018 |
| CN | 206985503 | | 2/2018 |
| CN | 207017968 | | 2/2018 |
| CN | 107859053 | A | 3/2018 |
| CN | 207057867 | | 3/2018 |
| CN | 207085817 | | 3/2018 |
| CN | 105545207 | B | 4/2018 |
| CN | 107883091 | A | 4/2018 |
| CN | 107902427 | A | 4/2018 |
| CN | 107939290 | A | 4/2018 |
| CN | 107956708 | | 4/2018 |
| CN | 207169595 | | 4/2018 |
| CN | 207194873 | | 4/2018 |
| CN | 207245674 | | 4/2018 |
| CN | 108034466 | A | 5/2018 |
| CN | 108036071 | A | 5/2018 |
| CN | 108087050 | A | 5/2018 |
| CN | 207380566 | | 5/2018 |
| CN | 108103483 | A | 6/2018 |
| CN | 108179046 | A | 6/2018 |
| CN | 108254276 | A | 7/2018 |
| CN | 108311535 | A | 7/2018 |
| CN | 207583576 | | 7/2018 |
| CN | 207634064 | | 7/2018 |
| CN | 207648054 | | 7/2018 |

(56) References Cited

FOREIGN PATENT DOCUMENTS

| | | | |
|---|---|---|---|
| CN | 207650621 | | 7/2018 |
| CN | 108371894 | A | 8/2018 |
| CN | 207777153 | | 8/2018 |
| CN | 108547601 | A | 9/2018 |
| CN | 108547766 | A | 9/2018 |
| CN | 108555826 | A | 9/2018 |
| CN | 108561098 | A | 9/2018 |
| CN | 108561750 | A | 9/2018 |
| CN | 108590617 | A | 9/2018 |
| CN | 207813495 | | 9/2018 |
| CN | 207814698 | | 9/2018 |
| CN | 207862275 | | 9/2018 |
| CN | 108687954 | A | 10/2018 |
| CN | 207935270 | | 10/2018 |
| CN | 207961582 | | 10/2018 |
| CN | 207964530 | | 10/2018 |
| CN | 108789848 | A | 11/2018 |
| CN | 108868675 | A | 11/2018 |
| CN | 208086829 | | 11/2018 |
| CN | 208089263 | | 11/2018 |
| CN | 108979569 | A | 12/2018 |
| CN | 109027662 | A | 12/2018 |
| CN | 109058092 | A | 12/2018 |
| CN | 208179454 | | 12/2018 |
| CN | 208179502 | | 12/2018 |
| CN | 208260574 | | 12/2018 |
| CN | 109114418 | A | 1/2019 |
| CN | 109141990 | A | 1/2019 |
| CN | 208313120 | | 1/2019 |
| CN | 208330319 | | 1/2019 |
| CN | 208342730 | | 1/2019 |
| CN | 208430982 | | 1/2019 |
| CN | 208430986 | | 1/2019 |
| CN | 109404274 | A | 3/2019 |
| CN | 109429610 | A | 3/2019 |
| CN | 109491318 | A | 3/2019 |
| CN | 109515177 | A | 3/2019 |
| CN | 109526523 | A | 3/2019 |
| CN | 109534737 | A | 3/2019 |
| CN | 208564504 | | 3/2019 |
| CN | 208564516 | | 3/2019 |
| CN | 208564525 | | 3/2019 |
| CN | 208564918 | | 3/2019 |
| CN | 208576026 | | 3/2019 |
| CN | 208576042 | | 3/2019 |
| CN | 208650818 | | 3/2019 |
| CN | 208669244 | | 3/2019 |
| CN | 109555484 | A | 4/2019 |
| CN | 109682881 | A | 4/2019 |
| CN | 208730959 | | 4/2019 |
| CN | 208735264 | | 4/2019 |
| CN | 208746733 | | 4/2019 |
| CN | 208749529 | | 4/2019 |
| CN | 208750405 | | 4/2019 |
| CN | 208764658 | | 4/2019 |
| CN | 109736740 | A | 5/2019 |
| CN | 109751007 | A | 5/2019 |
| CN | 208868428 | | 5/2019 |
| CN | 208870761 | | 5/2019 |
| CN | 109869294 | A | 6/2019 |
| CN | 109882144 | A | 6/2019 |
| CN | 109882372 | A | 6/2019 |
| CN | 209012047 | | 6/2019 |
| CN | 209100025 | | 7/2019 |
| CN | 110080707 | A | 8/2019 |
| CN | 110118127 | A | 8/2019 |
| CN | 110124574 | A | 8/2019 |
| CN | 110145277 | A | 8/2019 |
| CN | 110145399 | A | 8/2019 |
| CN | 110152552 | A | 8/2019 |
| CN | 110155193 | A | 8/2019 |
| CN | 110159225 | A | 8/2019 |
| CN | 110159432 | | 8/2019 |
| CN | 110159432 | A | 8/2019 |
| CN | 110159433 | A | 8/2019 |
| CN | 110208100 | A | 9/2019 |
| CN | 110252191 | A | 9/2019 |
| CN | 110284854 | A | 9/2019 |
| CN | 110284972 | A | 9/2019 |
| CN | 209387358 | | 9/2019 |
| CN | 110374745 | A | 10/2019 |
| CN | 209534736 | | 10/2019 |
| CN | 110425105 | A | 11/2019 |
| CN | 110439779 | A | 11/2019 |
| CN | 110454285 | A | 11/2019 |
| CN | 110454352 | A | 11/2019 |
| CN | 110467298 | A | 11/2019 |
| CN | 110469312 | A | 11/2019 |
| CN | 110469314 | A | 11/2019 |
| CN | 110469405 | A | 11/2019 |
| CN | 110469654 | A | 11/2019 |
| CN | 110485982 | A | 11/2019 |
| CN | 110485983 | A | 11/2019 |
| CN | 110485984 | A | 11/2019 |
| CN | 110486249 | A | 11/2019 |
| CN | 110500255 | A | 11/2019 |
| CN | 110510771 | A | 11/2019 |
| CN | 110513097 | A | 11/2019 |
| CN | 209650738 | | 11/2019 |
| CN | 209653968 | | 11/2019 |
| CN | 209654004 | | 11/2019 |
| CN | 209654022 | | 11/2019 |
| CN | 209654128 | | 11/2019 |
| CN | 209656622 | | 11/2019 |
| CN | 107849130 | B | 12/2019 |
| CN | 108087050 | B | 12/2019 |
| CN | 110566173 | A | 12/2019 |
| CN | 110608030 | A | 12/2019 |
| CN | 110617187 | A | 12/2019 |
| CN | 110617188 | A | 12/2019 |
| CN | 110617318 | A | 12/2019 |
| CN | 209740823 | | 12/2019 |
| CN | 209780827 | | 12/2019 |
| CN | 209798631 | | 12/2019 |
| CN | 209799942 | | 12/2019 |
| CN | 209800178 | | 12/2019 |
| CN | 209855723 | | 12/2019 |
| CN | 209855742 | | 12/2019 |
| CN | 209875063 | | 12/2019 |
| CN | 110656919 | A | 1/2020 |
| CN | 107520526 | B | 2/2020 |
| CN | 110787667 | A | 2/2020 |
| CN | 110821464 | A | 2/2020 |
| CN | 110833665 | A | 2/2020 |
| CN | 110848028 | A | 2/2020 |
| CN | 210049880 | | 2/2020 |
| CN | 210049882 | | 2/2020 |
| CN | 210097596 | | 2/2020 |
| CN | 210105817 | | 2/2020 |
| CN | 210105818 | | 2/2020 |
| CN | 210105993 | | 2/2020 |
| CN | 110873093 | A | 3/2020 |
| CN | 210139911 | | 3/2020 |
| CN | 110947681 | A | 4/2020 |
| CN | 111058810 | A | 4/2020 |
| CN | 111075391 | A | 4/2020 |
| CN | 210289931 | | 4/2020 |
| CN | 210289932 | | 4/2020 |
| CN | 210289933 | | 4/2020 |
| CN | 210303516 | | 4/2020 |
| CN | 211412945 | | 4/2020 |
| CN | 111089003 | A | 5/2020 |
| CN | 111151186 | A | 5/2020 |
| CN | 111167769 | A | 5/2020 |
| CN | 111169833 | A | 5/2020 |
| CN | 111173476 | A | 5/2020 |
| CN | 111185460 | A | 5/2020 |
| CN | 111185461 | A | 5/2020 |
| CN | 111188763 | A | 5/2020 |
| CN | 111206901 | A | 5/2020 |
| CN | 111206992 | A | 5/2020 |
| CN | 111206994 | A | 5/2020 |
| CN | 210449044 | | 5/2020 |
| CN | 210460875 | | 5/2020 |

(56) References Cited

FOREIGN PATENT DOCUMENTS

| | | | |
|---|---|---|---|
| CN | 210522432 | | 5/2020 |
| CN | 210598943 | | 5/2020 |
| CN | 210598945 | | 5/2020 |
| CN | 210598946 | | 5/2020 |
| CN | 210599194 | | 5/2020 |
| CN | 210599303 | | 5/2020 |
| CN | 210600110 | | 5/2020 |
| CN | 111219326 | A | 6/2020 |
| CN | 111350595 | A | 6/2020 |
| CN | 210660319 | | 6/2020 |
| CN | 210714569 | | 6/2020 |
| CN | 210769168 | | 6/2020 |
| CN | 210769169 | | 6/2020 |
| CN | 210769170 | | 6/2020 |
| CN | 210770133 | | 6/2020 |
| CN | 210825844 | | 6/2020 |
| CN | 210888904 | | 6/2020 |
| CN | 210888905 | | 6/2020 |
| CN | 210889242 | | 6/2020 |
| CN | 111397474 | A | 7/2020 |
| CN | 111412064 | A | 7/2020 |
| CN | 111441923 | A | 7/2020 |
| CN | 111441925 | A | 7/2020 |
| CN | 111503517 | A | 8/2020 |
| CN | 111515898 | A | 8/2020 |
| CN | 111594059 | A | 8/2020 |
| CN | 111594062 | A | 8/2020 |
| CN | 111594144 | A | 8/2020 |
| CN | 211201919 | | 8/2020 |
| CN | 211201920 | | 8/2020 |
| CN | 211202218 | | 8/2020 |
| CN | 111608965 | A | 9/2020 |
| CN | 111664087 | A | 9/2020 |
| CN | 111677476 | A | 9/2020 |
| CN | 111677647 | A | 9/2020 |
| CN | 111692064 | A | 9/2020 |
| CN | 111692065 | A | 9/2020 |
| CN | 211384571 | | 9/2020 |
| CN | 211397553 | | 9/2020 |
| CN | 211397677 | | 9/2020 |
| CN | 211500955 | | 9/2020 |
| CN | 211524765 | | 9/2020 |
| DE | 4241614 | | 6/1994 |
| DE | 102012018825 | | 3/2014 |
| EP | 0835983 | | 4/1998 |
| EP | 1378683 | | 1/2004 |
| EP | 2143916 | | 1/2010 |
| EP | 2613023 | | 7/2013 |
| EP | 3095989 | | 11/2016 |
| EP | 3211766 | | 8/2017 |
| EP | 3354866 | | 8/2018 |
| GB | 1438172 | | 6/1976 |
| JP | S57135212 | | 2/1984 |
| KR | 20020026398 | | 4/2002 |
| RU | 13562 | | 4/2000 |
| WO | 1993020328 | | 10/1993 |
| WO | 2006025886 | | 3/2006 |
| WO | 2009023042 | | 2/2009 |
| WO | 2012139380 | | 10/2012 |
| WO | 2013185399 | | 12/2013 |
| WO | 2015158020 | | 10/2015 |
| WO | 2016033983 | | 3/2016 |
| WO | 2016078181 | | 5/2016 |
| WO | 2016101374 | | 6/2016 |
| WO | 2016112590 | | 7/2016 |
| WO | 2017213848 | | 12/2017 |
| WO | 2018031029 | | 2/2018 |
| WO | 2018038710 | | 3/2018 |
| WO | 2018044293 | | 3/2018 |
| WO | 2018044307 | | 3/2018 |
| WO | 2018071738 | | 4/2018 |
| WO | 2018101909 | | 6/2018 |
| WO | 2018101912 | | 6/2018 |
| WO | 2018106210 | | 6/2018 |
| WO | 2018106225 | | 6/2018 |
| WO | 2018106252 | | 6/2018 |
| WO | 2018156131 | | 8/2018 |
| WO | 2018075034 | | 10/2018 |
| WO | 2018187346 | | 10/2018 |
| WO | 2018031031 | | 2/2019 |
| WO | 2019045691 | | 3/2019 |
| WO | 2019060922 | | 3/2019 |
| WO | 2019126742 | | 6/2019 |
| WO | 2019147601 | | 8/2019 |
| WO | 2019169366 | | 9/2019 |
| WO | 2019200510 | | 10/2019 |
| WO | 2019210417 | | 11/2019 |
| WO | 2020018068 | | 1/2020 |
| WO | 2020072076 | | 4/2020 |
| WO | 2020104088 | | 5/2020 |
| WO | 2020131085 | | 6/2020 |
| WO | 2020211083 | | 10/2020 |
| WO | 2020211086 | | 10/2020 |

OTHER PUBLICATIONS

Capstone Turbine Corporation, Capstone Receives Three Megawatt Order from Large Independent Oil & Gas Company in Eagle Ford Shale Play, Dec. 7, 2010.

Wikipedia, Westinghouse Combustion Turbine Systems Division, https://en.wikipedia.org/wiki/Westinghouse_Combustion_Turbine_Systems_Division, circa 1960.

Wikipedia,Union Pacific GTELs, https://en.wikipedia.org/wiki/Union_Pacific_GTELs, circa 1950.

HCI JET Frac, Screenshots from YouTube, Dec. 11, 2010. https://www.youtube.com/watch?v=6HjXkdbFaFQ.

AFD Petroleum Ltd., Automated Hot Zone, Frac Refueling System, Dec. 2018.

Eygun, Christiane, et al., URTeC: 2687987, Mitigating Shale Gas Developments Carbon Footprint: Evaluating and Implementing Solutions in Argentina, Copyright 2017, Unconventional Resources Technology Conference.

Walzel, Brian, Hart Energy, Oil, Gas Industry Discovers Innovative Solutions to Environmental Concerns, Dec. 10, 2018.

Frac Shack, Bi-Fuel FracFueller brochure, 2011.

Pettigrew, Dana, et al., High Pressure Multi-Stage Centrifugal Pump for 10,000 psi Frac Pump—HPHPS Frac Pump, Copyright 2013, Society of Petroleum Engineers, SPE 166191.

Elle Seybold, et al., Evolution of Dual Fuel Pressure Pumping for Fracturing: Methods, Economics, Field Trial Results and Improvements in Availability of Fuel, Copyright 2013, Society of Petroleum Engineers, SPE 166443.

Wallace, E.M., Associated Shale Gas: From Flares to Rig Power, Copyright 2015, Society of Petroleum Engineers, SPE-173491-MS.

Williams, C.W. (Gulf Oil Corp. Odessa Texas), The Use of Gas-turbine Engines in an Automated High-Pressure Water-injection Stations; American Petroleum Institute; API-63-144 (Jan. 1, 1963).

Neal, J.C. (Gulf Oil Corp. Odessa Texas), Gas Turbine Driven Centrifugal Pumps for High Pressure Water Injection; American Institute of Mining, Metallurgical and Petroleum Engineers, Inc.; SPE-1888 (1967).

Porter, John A. (SOLAR Division International Harvester Co.), Modern Industrial Gas Turbines for the Oil Field; American Petroleum Institute; Drilling and Production Practice; API-67-243 (Jan. 1, 1967).

Cooper et al., Jet Frac Porta-Skid—A New Concept in Oil Field Service Pump Equipments[sic]; Halliburton Services; SPE-2706 (1969).

Ibragimov, É.S., Use of gas-turbine engines in oil field pumping units; Chem Petrol Eng; (1994) 30: 530. https://doi.org/10.1007/BF01154919. (Translated from Khimicheskaya i Neftyanoe Mashinostroenie, No. 11, pp. 24-26, Nov. 1994.).

Kas'yanov et al., Application of gas-turbine engines in pumping units complexes of hydraulic fracturing of oil and gas reservoirs; Exposition Oil & Gas; (Oct. 2012) (published in Russian).

AFGlobal Corporation, Durastim Hydraulic Fracturing Pump, A Revolutionary Design for Continuous Duty Hydraulic Fracturing, 2018.

(56) References Cited

OTHER PUBLICATIONS

ResearchGate, Answer by Byron Woolridge, found at https://www.researchgate.net/post/How_can_we_improve_the_efficiency_of_the_gas_turbine_cycles, Jan. 1, 2013.
Filipović, Ivan, Preliminary Selection of Basic Parameters of Different Torsional Vibration Dampers Intended for use in Medium-Speed Diesel Engines, Transactions of Famena XXXVI-3 (2012).
Marine Turbine Technologies, 1 MW Power Generation Package, http://marineturbine.com/power-generation, 2017.
Business Week: Fiber-optic cables help fracking, cablinginstall.com. Jul. 12, 2013. https://www.cablinginstall.com/cable/article/16474208/businessweek-fiberoptic-cables-help-fracking.
Fracking companies switch to electric motors to power pumps, iadd-intl.org. Jun. 27, 2019. https://www.iadd-intl.org/articles/fracking-companies-switch-to-electric-motors-to-power-pumps/.
The Leader in Frac Fueling, suncoastresources.com. Jun. 29, 2015. https://web.archive.org/web/20150629220609/https://www.suncoastresources.com/oilfield/fueling-services/.
Mobile Fuel Delivery, atlasoil.com. Mar. 6, 2019. https://www.atlasoil.com/nationwide-fueling/onsite-and-mobile-fueling.
Frac Tank Hose (FRAC), 4starhose.com. Accessed: Nov. 10, 2019. http://www.4starhose.com/product/frac_tank_hose_frac.aspx.
PLOS One, Dynamic Behavior of Reciprocating Plunger Pump Discharge Valve Based on Fluid Structure Interaction and Experimental Analysis. Oct. 21, 2015.
FMC Technologies, Operation and Maintenance Manual, L06 Through L16 Triplex Pumps Doc No: OMM50000903 Rev: E p. 1 of 66. Aug. 27, 2009.
Gardner Denver Hydraulic Fracturing Pumps GD 3000 https://www.gardnerdenver.com/en-us/pumps/triplex-fracking-pump-gd-3000.
Lekontsev, Yu M., et al. "Two-side sealer operation." Journal of Mining Science 49.5 (2013): 757-762.
Tom Hausfeld, GE Power & Water, and Eldon Schelske, Evolution Well Services, TM2500+ Power for Hydraulic Fracturing.
FTS International's Dual Fuel Hydraulic Fracturing Equipment Increases Operational Efficiencies, Provides Cost Benefits, Jan. 3, 2018.
CNG Delivery, Fracturing with natural gas, dual-fuel drilling with CNG, Aug. 22, 2019.
PbNG, Natural Gas Fuel for Drilling and Hydraulic Fracturing, Diesel Displacement / Dual Fuel & Bi-Fuel, May 2014.
Integrated Flow, Skid-mounted Modular Process Systems, https://ifsolutions.com/.
Cameron, A Schlumberger Company, Frac Manifold Systems, 2016.
ZSi-Foster, Energy { Solar { Fracking { Oil and Gas, https://www.zsi-foster.com/energy-solar-fracking-oil-and-gas.html.
JBG Enterprises, Inc., WS-Series Blowout Prevention Safety Coupling—Quick Release Couplings, http://www.jgbhose.com/products/WS-Series-Blowout-Prevention-Safety-Coupling.asp.
Halliburton, Vessel-based Modular Solution (VMS), 2015.
Chun, M. K., H. K. Song, and R. Lallemand. "Heavy duty gas turbines in petrochemical plants: Samsung's Daesan plant (Korea) beats fuel flexibility records with over 95% hydrogen in process gas." Proceedings of PowerGen Asia Conference, Singapore. 1999.
Wolf, Jürgen J., and Marko A. Perkavec. "Safety Aspects and Environmental Considerations for a 10 MW Cogeneration Heavy Duty Gas Turbine Burning Coke Oven Gas with 60% Hydrogen Content." ASME 1992 International Gas Turbine and Aeroengine Congress and Exposition. American Society of Mechanical Engineers Digital Collection, 1992.
Ginter, Timothy, and Thomas Bouvay. "Uprate options for the MS7001 heavy duty gas turbine." GE paper GER-3808C, GE Energy 12 (2006).
Chaichan, Miqdam Tariq. "The impact of equivalence ratio on performance and emissions of a hydrogen-diesel dual fuel engine with cooled exhaust gas recirculation." International Journal of Scientific & Engineering Research 6.6 (2015): 938-941.
Ecob, David J., et al. "Design and Development of a Landfill Gas Combustion System for the Typhoon Gas Turbine." ASME 1996 International Gas Turbine and Aeroengine Congress and Exhibition. American Society of Mechanical Engineers Digital Collection, 1996.
II-VI Marlow Industries, Thermoelectric Technologies in Oil, Gas, and Mining Industries, blog.marlow.com (Jul. 24, 2019).
B.M. Mahlalela, et al., .Electric Power Generation Potential Based on Waste Heat and Geothermal Resources in South Africa, pangea.stanford.edu (Feb. 11, 2019).
Department of Energy, United States of America, The Water-Energy Nexus: Challenges and Opportunities purenergypolicy.org (Jun. 2014).
Ankit Tiwari, Design of a Cooling System for a Hydraulic Fracturing Equipment, The Pennsylvania State University, The Graduate School, College of Engineering, 2015.
Jp Yadav et al., Power Enhancement of Gas Turbine Plant by Intake Air Fog Cooling, Jun. 2015.
Mee Industries: Inlet Air Fogging Systems for Oil, Gas and Petrochemical Processing, Verdict Media Limited Copyright 2020.
M. Ahmadzadehtalatapeh et al.Performance enhancement of gas turbine units by retrofitting with inlet air cooling technologies (IACTs): an hour-by-hour simulation study, Journal of the Brazilian Society of Mechanical Sciences and Engineering, Mar. 2020.
Advances in Popular Torque-Link Solution Offer OEMs Greater Benefit, Jun. 21, 2018.
Emmanuel Akita et al., Mewbourne College of Earth & Energy, Society of Petroleum Engineers; Drilling Systems Automation Technical Section (DSATS); 2019.
PowerShelter Kit II, nooutage.com, Sep. 6, 2019.
EMPengineering.com, HEMP Resistant Electrical Generators / Hardened Structures HEMP/GMD Shielded Generators, Virginia.
Blago Minovski, Coupled Simulations of Cooling and Engine Systems for Unsteady Analysis of the Benefits of Thermal Engine Encapsulation, Department of Applied Mechanics, Chalmers University of Technology Goteborg, Sweden 2015.
J. Porteiro et al., Feasibility of a new domestic CHP trigeneration with heat pump: II. Availability analysis. Design and development, Applied Thermal Engineering 24 (2004) 1421-1429.

* cited by examiner

STAGE PROFILES FOR OPERATIONS OF HYDRAULIC SYSTEMS AND ASSOCIATED METHODS

PRIORITY CLAIM

This U.S. non-provisional patent application claims priority to and the benefit of, under 35 U.S.C. § 119(e), U.S. Provisional Application No. 62/705,332, filed Jun. 22, 2020, titled "METHODS AND SYSTEMS TO ENHANCE OPERATION OF HYDRAULIC FRACTURING EQUIPMENT AT A HYDRAULIC FRACTURING WELLSITE BY HYDRAULIC FRACTURING STAGE PROFILES," and U.S. Provisional Application No. 62/705,356, filed Jun. 23, 2020, titled "STAGE PROFILES FOR OPERATIONS OF HYDRAULIC SYSTEMS AND ASSOCIATED METHODS," the disclosures of both of which are incorporated herein by reference in their entirety.

TECHNICAL FIELD

The present disclosure relates to methods and systems for enhancing operation of hydraulic fracturing equipment at a hydraulic fracturing wellsite.

BACKGROUND

Hydrocarbon exploration and energy industries employ various systems and operations to accomplish activities including drilling, formation evaluation, stimulation and production. Hydraulic fracturing may be utilized to produce oil and gas economically from low permeability reservoir rocks or other formations, for example, shale, at a wellsite. During a hydraulic fracturing stage, slurry may be pumped, via hydraulic fracturing pumps, under high pressure to perforations, fractures, pores, faults, or other spaces in the reservoir rocks or formations. The slurry may be pumped at a rate faster than the reservoir rocks or formation may accept. As the pressure of the slurry builds, the reservoir rocks or formation may fail and begin to fracture further. As the pumping of the slurry continues, the fractures may expand and extend in different directions away from a well bore. Once the reservoir rocks or formations are fractured, the hydraulic fracturing pumps may remove the slurry. As the slurry is removed, proppants in the slurry may be left behind and may prop or keep open the newly formed fractures, thus preventing the newly formed fractures from closing or, at least, reducing contracture of the newly formed fractures. Further, after the slurry is removed and the proppants are left behind, production streams of hydrocarbons may be obtained from the reservoir rocks or formation.

For a wellsite, a plurality of hydraulic fracturing stages may be performed. Further, each hydraulic fracturing stage may require configuration of many and various hydraulic fracturing equipment. For example, prior to a next hydraulic fracturing stage, an operator or user may enter multiple data points for that next hydraulic fracturing stage for each piece of equipment, such as, for hydraulic fracturing pumps, a blender, a chemical additive unit, a hydration unit, a conveyor, and/or other hydraulic fracturing equipment located at the wellsite. As each hydraulic fracturing stage arises, data entry or other inputs at each piece of hydraulic fracturing equipment may not be performed efficiently and effectively; thus, such tasks may be considered time consuming and may result in user error.

Accordingly, Applicant has recognized a need for methods and system to enhance operation of hydraulic fracturing equipment at a hydraulic fracturing wellsite. The present disclosure may address one or more of the above-reference drawbacks, as well as other potential drawbacks.

SUMMARY

Accordingly, Applicant has recognized a need for methods and system to enhance operation of hydraulic fracturing equipment at a hydraulic fracturing wellsite. The present disclosure may address one or more of the above-reference drawbacks, as well as other potential drawbacks.

As referenced above, due to a large number of hydraulic fracturing stages and the large number of hydraulic fracturing equipment associated with the hydraulic fracturing stages, setting hydraulic fracturing stage parameters may be difficult, complex, and time-consuming and may introduce error into the process. Further, the manual input of each data point for the hydraulic fracturing stages at each piece of the hydraulic fracturing equipment may result in longer periods of time between hydraulic fracturing stages, thus resulting in a longer overall period of time for entire hydraulic fracturing operations.

The present disclosure generally is directed to methods and systems for operating hydraulic fracturing equipment at a hydraulic fracturing wellsite. In some embodiments, the methods and systems may provide for efficient and enhanced operation of the hydraulic fracturing equipment, for example, during setup or as hydraulic fracturing equipment stages through various operations.

An embodiment of the disclosure provides a method of enhancing operation of hydraulic fracturing equipment at a hydraulic fracturing wellsite. The method may include determining if a previous hydraulic fracturing stage profile or one or more hydraulic fracturing stage profiles may be available for use in association with a controller for hydraulic fracturing equipment at a hydraulic fracturing wellsite. The one or more profiles may include hydraulic fracturing pumping stage parameters for a hydraulic fracturing fleet and a plurality of hydraulic fracturing pumping stages at a fracturing wellsite during hydrocarbon production. The method may include, in response to a determination that the previous hydraulic fracturing stage profile is available for use by the controller, prompting, at a display, a user to accept or amend the previous hydraulic fracturing stage profile as a current hydraulic fracturing stage profile for a hydraulic fracturing pumping stage. The method may further include, in response to a reception of an amendment of the previous hydraulic fracturing stage profile, prompting, at the display, the user to accept the amended previous hydraulic fracturing stage profile as the current hydraulic fracturing stage profile, and storing the current hydraulic fracturing stage profile in memory as another previous hydraulic fracturing stage profile for use in association with the controller. The method may further include, in response to a determination that the previous hydraulic fracturing stage profile is not available for use in association with the controller, prompting, at the display, a user to configure hydraulic fracturing pumping stage parameters for the current hydraulic fracturing stage profile, storing the current hydraulic fracturing stage profile in memory as the previous hydraulic fracturing stage profile for use in association with the controller, and verifying that the hydraulic fracturing pumping stage parameters in the current hydraulic fracturing stage profile are correct.

Another embodiment of the disclosure provides a method of enhancing operation of hydraulic fracturing equipment at a hydraulic fracturing wellsite. The method may include building a new or a first hydraulic fracturing stage profile for a new hydraulic fracturing stage at the hydraulic fracturing wellsite, based, at least, in part on one or more hydraulic fracturing stage profiles, data from a hydraulic fracturing fleet, and hydraulic fracturing fleet alarm history. The one or more hydraulic fracturing stage profiles may include hydraulic fracturing pumping stage parameters for the hydraulic fracturing fleet and a plurality of hydraulic fracturing pumping stages at the hydraulic fracturing wellsite during hydrocarbon production. The method may include, in response to completion of the new hydraulic fracturing stage profile, prompting, at a display, a user to accept or amend the new hydraulic fracturing stage profile as a current hydraulic fracturing stage profile for the new hydraulic fracturing pumping stage. The method may further include, in response to a reception of an amendment of the new hydraulic fracturing stage profile, prompting, at the display, the user to accept the amended new hydraulic fracturing stage profile as the current hydraulic fracturing stage profile, and storing the current hydraulic fracturing stage profile in memory as another previous hydraulic fracturing stage profile for use in association with the controller. The method may further include verifying that the hydraulic fracturing pumping stage parameters in the current hydraulic fracturing stage profile are correct.

According to another embodiment of the disclosure, a wellsite hydraulic fracturing system may include a plurality of hydraulic fracturing pumps. The plurality of hydraulic fracturing pumps, when positioned at a hydraulic fracturing wellsite, may be configured to provide a slurry to a wellhead in hydraulic fracturing pumping stages. The wellsite hydraulic fracturing system also may include a blender configured to provide a slurry to the plurality of hydraulic fracturing pumps. The slurry may include fluid, chemicals, and proppant. The wellsite hydraulic fracturing system also may include a hydration unit to provide fluid to the blender. The wellsite hydraulic fracturing system further may include a chemical additive unit to provide chemicals to the blender. The wellsite hydraulic fracturing system also may include a conveyor or auger, for example, to provide proppant to the blender. The wellsite hydraulic fracturing system further may include one or more controllers to control the hydraulic fracturing pumps, blender, hydration unit, chemical additive unit, and conveyor or auger. The one or more controllers may be positioned in signal communication with a terminal, a computing device, and sensors included on the plurality of hydraulic fracturing pumps, the blender, the hydration unit, the chemical additive unit, and the conveyor or auger. The one or more controllers may include a processor and a memory. The memory may store instructions or computer programs, as will be understood by those skilled in the art. The instructions or computer programs may be executed by the processor. The instructions, when executed, may determine if hydraulic fracturing stage profiles are available for use in the hydraulic fracturing pumping stages, and may, in response to a determination that the hydraulic fracturing stage profiles are not available for use, communicate a prompt at the terminal to enter hydraulic fracturing stage parameters for a current hydraulic fracturing stage profile and for a new or current hydraulic fracturing stage. The instructions, when executed, also may, in response to a determination that the hydraulic fracturing stage profiles are available for use, communicate a prompt at the terminal to utilize one of the hydraulic fracturing stage profiles or to amend one of the hydraulic fracturing stage profiles for the current hydraulic fracturing stage profile and may, in response to an entry or amendment of the hydraulic fracturing stage parameters for the current hydraulic fracturing stage profile at the terminal, store the current hydraulic fracturing stage profile to the computing device with an indicator. The indicator, for example, may indicate that the current hydraulic fracturing stage profile is associated with the current hydraulic fracturing pumping stage. Further, the instructions, when executed, may communicate a prompt to the terminal requesting acceptance of the use of the current hydraulic fracturing stage profile for the current hydraulic fracturing stage.

According to another embodiment of the disclosure, a controller for a hydraulic fracturing system may include a terminal input/output in signal communication with a terminal. The controller may be configured to, in relation to the terminal and in response to a determination that no hydraulic fracturing stage profiles are available for use, provide a prompt to the terminal to enter data for a hydraulic fracturing stage of a plurality of hydraulic fracturing stages into a first hydraulic fracturing stage profile. The controller, in relation to the terminal, also may be configured to receive the first hydraulic fracturing stage profile from the terminal. The controller, in relation to the terminal and in response to a determination that one or more hydraulic fracturing stage profiles are available, also may be configured to provide a prompt to the terminal requesting utilization or amendment of one of the hydraulic fracturing stage profiles for another hydraulic fracturing stage of the plurality of hydraulic fracturing stages. The controller may be configured to receive acceptance of the use of one of the hydraulic fracturing stage profiles for the another hydraulic fracturing stage. Further, the controller may be configured to receive an amended hydraulic fracturing stage profile of the hydraulic fracturing stage profiles for the another hydraulic fracturing stage. The controller may include a server input/output in signal communication with a server such that each hydraulic fracturing stage profile, including indicators of associated hydraulic fracturing stages, are communicated between the controller and the server. The controller may also include a first control output in signal communication with the plurality of hydraulic fracturing pumps such that the controller provides pump control signals based on a stage of the plurality of hydraulic fracturing stages and an associated hydraulic fracturing stage profile. The controller, for example, may be a supervisory controller, and each of the plurality of hydraulic fracturing pumps also may include a controller in signal communication with the supervisory controller as will be understood by those skilled in the art.

Still other aspects and advantages of these embodiments and other embodiments, are discussed in detail herein. Moreover, it is to be understood that both the foregoing information and the following detailed description provide merely illustrative examples of various aspects and embodiments, and are intended to provide an overview or framework for understanding the nature and character of the claimed aspects and embodiments. Accordingly, these and other objects, along with advantages and features of the present disclosure, will become apparent through reference to the following description and the accompanying drawings. Furthermore, it is to be understood that the features of the various embodiments described herein are not mutually exclusive and may exist in various combinations and permutations.

BRIEF DESCRIPTION OF THE DRAWINGS

The accompanying drawings, which are included to provide a further understanding of the embodiments of the present disclosure, are incorporated in and constitute a part of this specification, illustrate embodiments of the present disclosure, and together with the detailed description, serve to explain principles of the embodiments discussed herein. No attempt is made to show structural details of this disclosure in more detail than may be necessary for a fundamental understanding of the embodiments discussed herein and the various ways in which they may be practiced. According to common practice, the various features of the drawings discussed below are not necessarily drawn to scale. Dimensions of various features and elements in the drawings may be expanded or reduced to more clearly illustrate embodiments of the disclosure.

DETAILED DESCRIPTION

Figure 1:
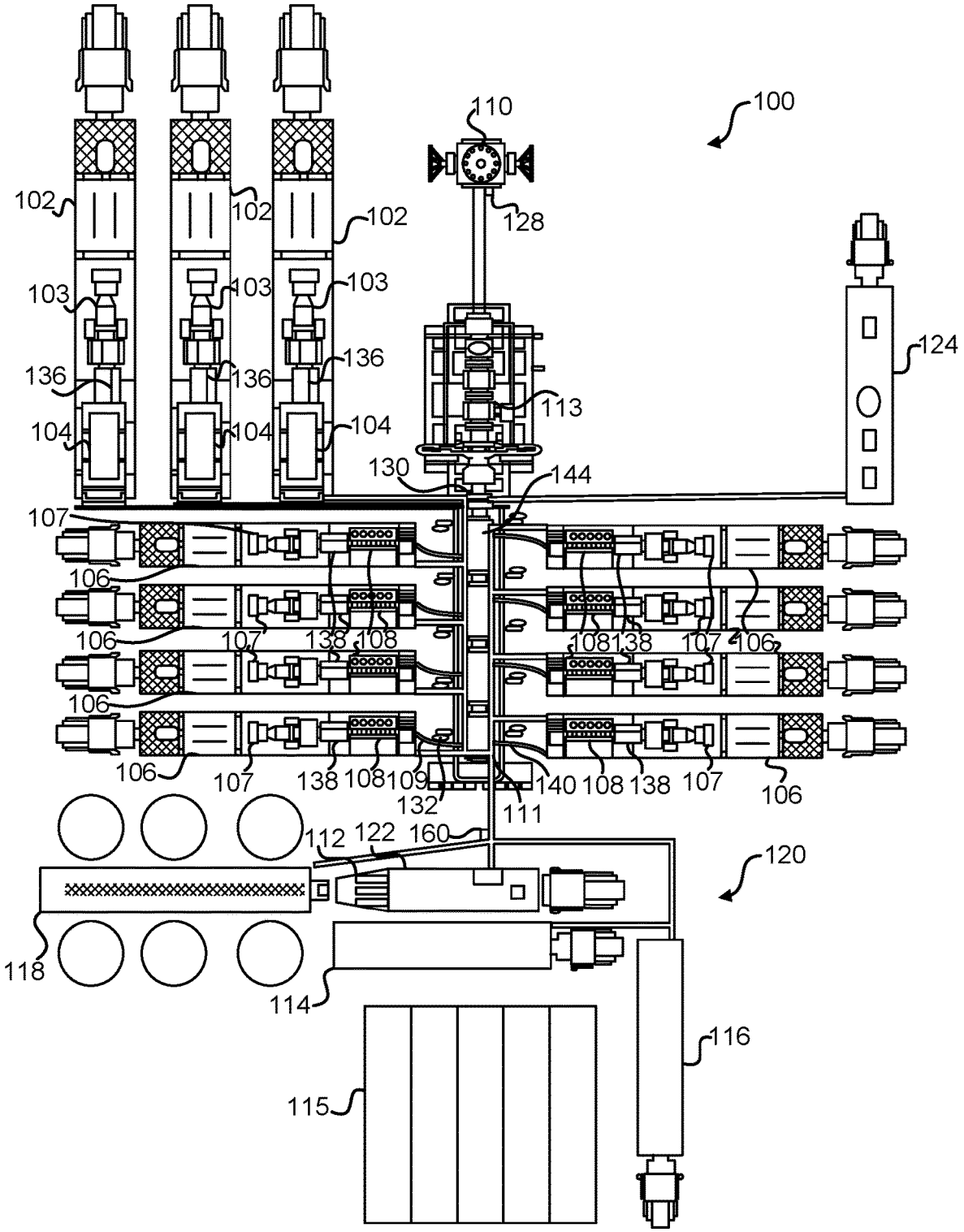
FIG. 1 is a top plan schematic view of a wellsite hydraulic fracturing pumper system, according to an embodiment of the disclosure.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect may be combined with features from any other embodiment or aspect in any appropriate combination. For example, any individual or collective features of method aspects or embodiments may be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

The phraseology and terminology used herein is for the purpose of description and should not be regarded as limiting. As used herein, the term "plurality" refers to two or more items or components. The terms "comprising," "including," "carrying," "having," "containing," and "involving," whether in the written description or the claims and the like, are open-ended terms, i.e., to mean "including but not limited to," unless otherwise stated. Thus, the use of such terms is meant to encompass the items listed thereafter, and equivalents thereof, as well as additional items. The transitional phrases "consisting of" and "consisting essentially of," are closed or semi-closed transitional phrases, respectively, with respect to any claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish claim elements.

Embodiments of the present disclosure are directed to methods and systems for enhancing operation of hydraulic fracturing equipment at a hydraulic fracturing wellsite. The methods and systems detailed herein may be executed on a controller which controls all equipment at the hydraulic fracturing wellsite and may provide prompts and requests to an operator in relation to utilizing and amending hydraulic fracturing stage profiles for hydraulic fracturing stages.

FIG. 1 is a top-down schematic view of a wellsite hydraulic fracturing system 100, according to an embodiment. The wellsite hydraulic fracturing system 100 may include a plurality of mobile power units 102 to drive electrical generators 104. The electrical generators 104 may provide electrical power to the wellsite hydraulic fracturing system 100 (in other words, to hydraulic fracturing equipment at the wellsite hydraulic fracturing system 100). In such examples, the mobile power units 102 may include an internal combustion engine 103. The internal combustion engine 103 may connect to a source of fuel. The internal combustion engine 103 may be a gas turbine engine (GTE) or a reciprocating-piston engine. In another embodiment, the electrical generators 104 may power the backside equipment 120.

In another embodiment, the GTEs may be dual-fuel or bi-fuel. In other words, the GTE may be operable using two or more different types of fuel, such as natural gas and diesel fuel, or other types of fuel. A dual-fuel or bi-fuel GTE may be operable using a first type of fuel, a second type of fuel, and/or a combination of the first type of fuel and the second type of fuel. For example, the fuel may include gaseous fuels, such as, compressed natural gas (CNG), natural gas, field gas, pipeline gas, methane, propane, butane, and/or liquid fuels, such as, diesel fuel (e.g., #2 diesel), bio-diesel fuel, bio-fuel, alcohol, gasoline, gasohol, aviation fuel, and other fuels. The gaseous fuels may be supplied by CNG bulk vessels, a gas compressor, a liquid natural gas vaporizer, line gas, and/or well-gas produced natural gas. Other types and associated fuel supply sources are contemplated. The one or more internal combustion engines 103 may be operated to provide horsepower to drive the transmission 136 connected to the electrical generators to provide electrical power to the hydraulic fracturing equipment at the wellsite hydraulic fracturing system 100.

The wellsite hydraulic fracturing system 100 may also include a plurality of mobile power units 106 to drive hydraulic fracturing pumps 108. In an embodiment, the mobile power unit 106 may be an internal combustion engine 107 (e.g., a GTE or reciprocating-piston engine). In another embodiment, the hydraulic fracturing pumps 108 may be a directly-driven turbine (DDT) hydraulic fracturing pumps. In such examples, the internal combustion engine 107 may connect to the DDT hydraulic fracturing pump via a transmission 138 connected to a drive shaft, the drive shaft connected to an input flange of the DDT hydraulic fracturing pump. Other engine-to-pump connections may be utilized. In another embodiment, the mobile power units 106 may include auxiliary internal combustion engines, auxiliary electric generators, backup power sources, and/or some combination thereof.

In another embodiment, the hydraulic fracturing pumps 108 may be positioned around a wellhead 110 and may discharge, at a high pressure, slurry to a manifold 144 such that the high pressure slurry may be provided to the wellhead 110 for a hydraulic fracturing stage, as will be understood by those skilled in the art. In such examples, each of the hydraulic fracturing pumps 108 may discharge the slurry through high-pressure discharge lines 109 to flow lines 111 on manifold 144. The flow lines 111 may connect to or combine at the manifold 144. The manifold 144 may provide the slurry or combined slurry to a manifold assembly 113. The manifold assembly 113 may provide the slurry to the wellhead 110 or one or more wellheads. After a hydraulic fracturing stage is complete, some portion of the slurry may return to a flowback manifold (not shown). From the flowback manifold, the slurry may flow to a flowback tank (not shown).

In an embodiment, the slurry may refer to a mixture of fluid (such as water), proppants, and chemical additives. The proppants may be small granules, for example, sand, ceramics, gravel, other particulates, and/or some combination thereof. Further, the granules may be coated in resin. As noted above, once fractures are introduced in reservoir rocks or formations and the slurry is drained or pumped back, the proppants may remain and prop or keep open the newly formed fractures, thus preventing the newly formed fractures from closing or, at least, reducing contracture of the newly formed fractures. Further, chemicals may be added to the slurry. For example, the chemicals may be thickening agents, gels, dilute acids, biocides, breakers, corrosion inhibitors, friction reducers, potassium chloride, oxygen scavengers, pH adjusting agents, scale inhibitors, and/or surfactants. Other chemical additives may be utilized.

The wellsite hydraulic fracturing system 100 may also include a blender unit 112, a hydration unit 114, a chemical additive unit 116, and a conveyor 118 (one or more of which may be referred to as backside equipment 120). In an embodiment, for a hydraulic fracturing stage, the blender unit 112 may provide an amount of slurry at a specified flow rate to the hydraulic fracturing pumps 108, the slurry to be discharged by the hydraulic fracturing pumps 108 to the wellhead 110 (as described above). The flow rate for slurry from the blender unit 112 may be determined by a sensor such as a flow meter (e.g., blender flow rate meter 160). Further, the conveyor 118 may provide proppant to a mixer 122 of the blender unit 112. The conveyor 118 may include a conveyor belt, an auger, a chute (including a mechanism to allow passage of a specified amount of proppant), and/or other equipment to move or transfer proppant to the blender unit 112, as will be understood by those skilled in the art. Further still, the hydration unit 114 may provide a specified amount of fluid, from water tanks 115, and chemicals, from the chemical additive unit 116, to the mixer 122 of the blender unit 112. The chemical additive unit 116 may provide a specified amount and type of chemicals to hydration unit 114. The mixer 122 of the blender unit 112 may mix the fluid, proppant, and chemicals to create the slurry to be utilized by the hydraulic fracturing pumps 108. As noted above, the blender unit 112 may then pressurize and discharge the slurry from hose 142 to flow line 140 to the hydraulic fracturing pumps 108.

In another embodiment, the wellsite hydraulic fracturing system 100, or a portion of the wellsite hydraulic fracturing system 100, may be mobile or portable. Such mobility may allow for the wellsite hydraulic fracturing system 100 to be assembled or disassembled quickly. For example, a majority of the hydraulic fracturing equipment may be included on trailers attached to vehicles or on the vehicles. When a wellsite starts hydraulic fracturing stages, the hydraulic fracturing equipment may be brought to the wellsite, assembled, and utilized and when the hydraulic fracturing stages are completed, the hydraulic fracturing equipment may be disassembled and transported to another wellsite. In such examples, data or hydraulic fracturing stage parameters may be retained by a supervisory controller 124 or another computing device for later use.

The wellsite hydraulic fracturing system 100 may also include a control unit, control center, data van, data center, controller, or supervisory controller 124 to monitor and control operations hydraulic fracturing equipment at the wellsite. In other words, the supervisory controller 124 may be in signal communication with the hydraulic fracturing equipment. The supervisory controller 124 may be in signal communication (to transmit and/or receive signals) with components, other controllers, and/or sensors included on or with the mobile power units 102 driving the electrical generators 104, the internal combustion engines 103, the mobile power units 106 driving the hydraulic fracturing pumps 108, the hydraulic fracturing pumps 108, the internal combustion engines 107, the manifold 144, the wellhead 110, the flow line 111, the hose 142, the backside equipment 120, other equipment at the wellsite, and/or some combination thereof. Further, other equipment may be included in the same location as the supervisory controller 124, such as a display or terminal, an input device, other computing devices, and/or other electronic devices.

As used herein, "signal communication" refers to electric communication such as hard wiring two components together or wireless communication, as will be understood by those skilled in the art. Wireless communication may be Wi-Fi®, Bluetooth®, ZigBee®, or forms of near field communications. In addition, signal communication may include one or more intermediate controllers or relays disposed between elements that are in signal communication with one another.

In another embodiment, the supervisory controller 124 may be in signal communication with a display, a terminal, and/or a computing device, as well as associated input devices. Further, the display may be included with a computing device. The computing device may include a user interface (the user interface to be displayed on the display). The user interface may be a graphical user interface (GUI).

In another embodiment, the user interface may be an operating system. In such examples, the operating system may include various firmware, software, and/or drivers that allow a user to communicate or interface with, via input devices, the hardware of the computing device and, thus, with the supervisory controller 124. The computing device may include other peripherals or input devices, e.g., a mouse, a pointer device, a keyboard, and/or a touchscreen. The supervisory controller 124 may communicate, send or transmit prompts, requests, or notifications to the display through the computing device to the display. As used herein, "user" may refer an operator, a single operator, a person, or any personnel at, or remote from, the wellsite hydraulic fracturing system 100. In another embodiment, a user may send data, e.g., through data entry, via an input device, into a computing device associated with the display for a hydraulic fracturing stage profile, from the display to the supervisory controller 124. The user may send responses, e.g., through user selection of a prompt, via the input device, on the display, from the display to the supervisory controller 124.

In an embodiment, the supervisory controller 124 may be in signal communication with the backside equipment 120 to control the hydraulic fracturing stage parameters for a hydraulic fracturing stage. In other words, the supervisory controller 124 may communicate the hydraulic fracturing stage parameters to and control the backside equipment 120 for a current hydraulic fracturing stage. Further, the supervisory controller 124 may communicate with controllers of the backside equipment 120. For example, the supervisory controller 124 may transmit, to controller 150 of the chemical additive unit 116, the amount and type of chemicals to be sent to the hydration unit 114 for the current hydraulic fracturing stage. The supervisory controller 124 may also transmit, through the signal communication, the amount of fluid, to the controller 148 of the hydration unit 114, to provide to the mixer 122 of the blender unit 112 for the current hydraulic fracturing stage. Further, the supervisory controller 124 may also transmit, through the signal communication, the amount and type of proppant, to controller 152 of the conveyor 118, to provide to the mixer 122 of the blender unit 112 for the current hydraulic fracturing stage. Further still, the supervisory controller 124 may transmit, through the signal communication, to a controller 154 of the blender unit 112 the flow rate of the slurry from the blender unit 112 to a set of the hydraulic fracturing pumps 108 for the current hydraulic fracturing stage. The supervisory controller 124 may also be in signal communication with the hydraulic fracturing pumps 108 and/or a controller 146 of the hydraulic fracturing pumps 108 to control or transmit the flow rate (minimum and/or maximum flow rate) of the discharge of the slurry from the set of the hydraulic fracturing pumps 108, the maximum pressure of the slurry, and/or the pressure rating (minimum and/or maximum pressure rate) of the slurry for the current hydraulic fracturing stage.

The supervisory controller 124 may also be in signal communication with various sensors, equipment, controllers and/or other components disposed around and on the hydraulic fracturing equipment at the wellsite hydraulic fracturing system 100. For example, the supervisory controller 124 may receive a measurement of pressure and flow rate of the slurry being delivered to the wellhead 110 from a wellhead pressure transducer 128, the pressure and flow rate of the slurry at a manifold pressure transducer 130, the pressure of the slurry at a hydraulic fracturing pump output pressure transducer 132, and/or data related to each of the hydraulic fracturing pumps 108 from a hydraulic fracturing pump profiler. The wellhead pressure transducer 128 may be disposed at the wellhead 110 to measure a pressure of the fluid at the wellhead 110. While the manifold pressure transducer 130 may be disposed at the end of the manifold 144 (as shown in FIG. 1), it will be understood by those skilled in the art, that the pressure within the manifold 144 may be substantially the same throughout the entire manifold 144 such that the manifold pressure transducer 130 may be disposed anywhere within the manifold 144 to provide a pressure of the fluid being delivered to the wellhead 110. The hydraulic fracturing pump output pressure transducer 132 may be disposed adjacent an output of one of the hydraulic fracturing pumps 108, which may be in fluid communication with the manifold 144 and thus, the fluid at the output of the hydraulic fracturing pumps 108 may be at substantially the same pressure as the fluid in the manifold 144 and the fluid being provided to the wellhead 110. Each of the hydraulic fracturing pumps 108 may include a hydraulic fracturing pump output pressure transducer 132, and the supervisory controller 124 may determine the fluid pressure provided to the wellhead 110 as an average of the fluid pressure measured by each of the hydraulic fracturing pump output pressure transducers 132.

Each of the hydraulic fracturing pumps 108 may include a hydraulic fracturing pump profiler. The hydraulic fracturing pump profiler may be instructions stored in a memory, executable by a processor, of a controller 146. In another embodiment, the hydraulic fracturing pump profiler may be another controller or other computing device. The controller 146 may be disposed on each of the one or more hydraulic fracturing pumps 108. The hydraulic fracturing pump profiler may provide various data points related to each of the one or more hydraulic fracturing pumps 108 to the supervisory controller 124, for example, the hydraulic fracturing pump profiler may provide data including hydraulic fracturing pump characteristics (minimum flow rate, maximum flow rate, harmonization rate, and/or hydraulic fracturing pump condition), maintenance data associated with the one or more hydraulic fracturing pumps 108 and mobile power units 106 (e.g., health, maintenance schedules and/or histories associated with the hydraulic fracturing pumps 108, the internal combustion engine 107, and/or the transmission 138), operation data associated with the one or more hydraulic fracturing pumps 108 and mobile power units 106 (e.g., historical data associated with horsepower, fluid pressures, fluid flow rates, etc., associated with operation of the hydraulic fracturing pumps 108 and mobile power units 106), data related to the transmissions 138 (e.g., hours of operation, health, efficiency, and/or installation age), data related to the internal combustion engines 107 (e.g., hours of operation, health, available power, and/or installation age), information related to the one or more hydraulic fracturing pumps 108 (e.g., hours of operation, plunger and/or stroke size, maximum speed, efficiency, health, and/or installation age), and/or equipment alarm history (e.g., life reduction events, pump cavitation events, pump pulsation events, and/or emergency shutdown events).

Figure 2A:
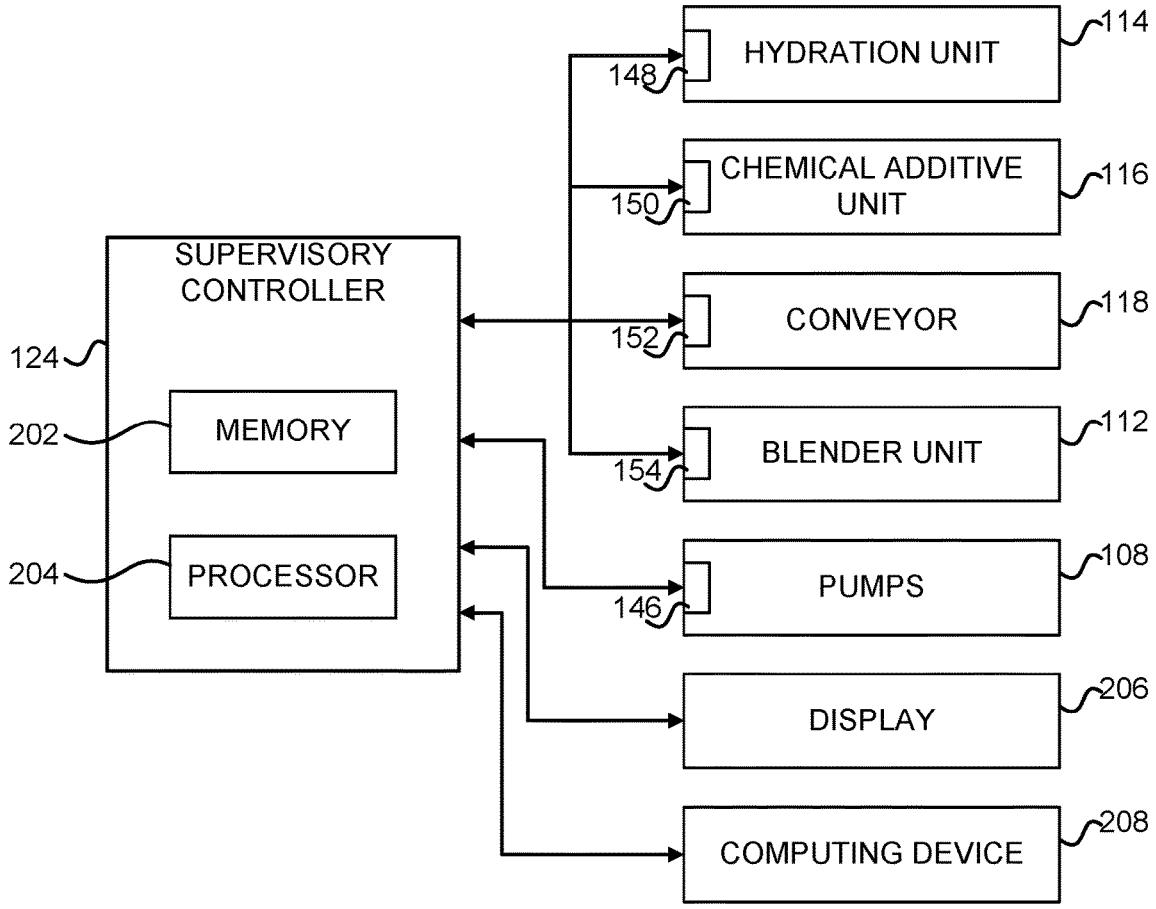
FIGS. 2A and 2B are block diagrams of a controller connected to backside equipment, hydraulic fracturing pumps, a display, and a computing device according to an embodiment of the disclosure.
Figure 2B:
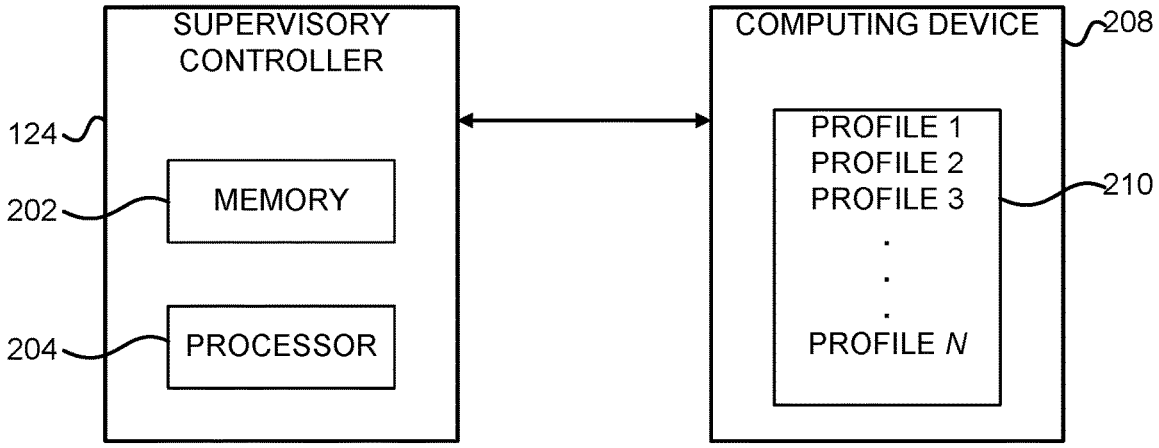

FIGS. 2A and 2B are block diagrams of a supervisory controller 124 in communication with backside equipment 120 (see FIG. 1), hydraulic fracturing pumps 108, a display 206, and a computing device 208, according to an embodiment. The supervisory controller 124 may include a non-transitory machine-readable storage medium (e.g., a memory 202) and processor 204. As used herein, a "machine-readable storage medium" may be any electronic, magnetic, optical, or other physical storage apparatus to contain or store information such as executable instructions, data, and the like. For example, any machine-readable storage medium described herein may be any of random access memory (RAM), volatile memory, non-volatile memory, flash memory, a storage drive (e.g., a hard drive), a solid state drive, any type of storage disc, and the like, or a combination thereof. As noted, the memory 202 may store or include instructions executable by the processor 204. As noted above, the supervisory controller 124 may utilize hydraulic fracturing stage profiles for hydraulic fracturing stages at the hydraulic fracture wellsite. In such embodiments, the hydraulic fracturing stage profile may include hydraulic fracturing stage parameters. For example, a hydraulic fracturing stage profile may include an amount of fluid for the hydration unit 114 to provide to the mixer 122 of the blender unit 112, an amount and type of chemicals for the chemical additive unit 116 to provide to the hydration unit 114, an amount and type of proppant for the conveyor 118 to provide to the mixer 122 of the blender 112, a flow rate of the slurry sent from the blender unit 112 to a set of the one or more hydraulic fracturing pumps 108, a flow rate for the set of the one or more hydraulic fracturing pumps 108 to indicate a flow rate from the hydraulic fracturing pumps 108 to the wellhead 110, a pressure rating for the set of the hydraulic fracturing pumps 108 to follow, and a maximum pressure for the set of the hydraulic fracturing pumps 108 to meet.

The supervisory controller 124 may include instructions stored in the memory 202, when executed by the processor 204, to determine whether previous hydraulic fracturing stage profiles are available for use in a current hydraulic fracturing stage profile. To determine that such previous hydraulic fracturing stage profiles exist, the supervisory controller 124 (in other words, the instructions executed by the processor 204) may check a local memory or other machine-readable storage medium included with or attached to the supervisory controller 124, a computing device 208, or some other specified location. In such examples, the supervisory controller 124 may include previous hydraulic fracturing stage profiles in memory 202 (as in, local memory), another machine-readable storage medium included in the supervisory controller 124, or a machine-readable storage medium connected or added to the supervisory controller 124 (such as, a USB key or an external hard drive). In another embodiment, the supervisory controller 124 may be in signal communication with a computing device 208. The computing device 208 may be a server, edge server, storage device, database, and/or personal computer (such as a desktop, laptop, workstation, tablet, or smart phone). The computing device 208 may store previous hydraulic fracturing stage profiles 210. Further, the computing device 208 may store previous hydraulic fracturing stage profiles 210 from a separate or different hydraulic fracturing wellsite. In other words, a previous wellsite at which at least portions of the wellsite hydraulic fracturing system 100 was used. As noted, the supervisory controller 124 may check the computing device 208 for any previous hydraulic fracturing stage profiles 210. The supervisory controller 124 may determine whether previous hydraulic fracturing stage profiles may be used in a current hydraulic fracturing stage profile based on the equipment available, data from the hydraulic fracturing pump profiler, and/or other data related to the wellsite hydraulic fracturing system 100.

The supervisory controller 124 may include instructions stored in the memory 202, when executed by the processor 204, to build a new hydraulic fracturing stage profile for the current hydraulic fracturing stage and/or further hydraulic fracturing stages. The supervisory controller 124 may build the new hydraulic fracturing stage profile based, at least, in part on one or more previous hydraulic fracturing stage profiles, data from the hydraulic fracturing fleet, data from one or more previous wellsites that the hydraulic fracturing fleet may have been utilized at, the hydraulic fracturing fleets alarm history, data from the hydraulic fracturing pump profiler or profilers, and/or data from the controller 146 of the one or more hydraulic fracturing pumps 108. The supervisory controller 124 may consider, when building the new hydraulic fracturing stage profile, geological data of the current wellsite and, if available, geological data of previous wellsites. For example, based on the geological data of the current wellsite, the supervisory controller 124 may set a specific type and amount of proppant and chemicals to be added to a slurry, an amount of water to be added to the slurry, and a flow rate of the slurry from the blender unit 112. In another embodiment, based on geological data and/or available hydraulic fracturing pumps 108 (availability which may be determined based on maintenance data, prior hydraulic fracturing stage completions, alerts/events, and/or other data described herein), the supervisory controller 124 may select which hydraulic fracturing pumps 108 may be utilized for a specific hydraulic fracturing stage. Other equipment and/or aspects for a hydraulic fracturing stage may be determined by the supervisory controller 124 based on other data described herein. After the new hydraulic fracturing stage profile is built, the supervisory controller 124 may prompt the user to utilize the new hydraulic fracturing stage profile for the current hydraulic fracturing stage. The supervisory controller 124 may build the new hydraulic fracturing stage profile by populating the new hydraulic fracturing stage profile with one or more hydraulic fracturing stage parameters, based on the data described above. Before selecting the new hydraulic fracturing stage profile, the user may amend new hydraulic fracturing stage profile.

The supervisory controller 124 may include instructions stored in the memory 202 which, when executed by the processor 204, may, in response to a determination the previous hydraulic fracturing stage profiles are not available (as described above), send prompts to the display 206 requesting that the user, for a current hydraulic fracturing stage, enter in, via an input device included with display 206 (described above), new hydraulic fracturing stage job parameters for a new or current hydraulic fracturing stage profile and a new or current hydraulic fracturing stage. In such examples, the instructions, when executed by the processor 204, may communicate or send a data packet including text to include on the display 206 and a form or data fields. The form or data fields may accept a user's input and include text indicating the purpose of a specific box in the form or a specific data field. The form or data fields may match or include boxes for each of the hydraulic fracturing stage parameters. In other words, the supervisory controller 124 may send a form, list, or data fields corresponding to the hydraulic fracturing stage parameters, thus, allowing a user to enter or alter or amend the hydraulic fracturing stage parameters for the new or current hydraulic fracturing stage. The instructions, when executed by the processor 204, may include an interactive save field or button. The interactive save field or button may allow the user to save entered hydraulic fracturing stage parameters as a new or current hydraulic fracturing stage profile.

The supervisory controller 124 may include instructions stored in the memory 202 which, when executed by the processor 204, may, in response to a determination the previous hydraulic fracturing stage profiles are available (as described above), communicate or send prompts to the display 206 requesting that the user, for a current hydraulic fracturing stage, accept or amend, at an input device included with display 206 (described above), one of the previous hydraulic fracturing stage profiles for the current hydraulic fracturing stage profile. In such examples, the instructions, when executed by the processor 204, may communicate or send a list of the previous hydraulic fracturing stage profiles. Each of the previous hydraulic fracturing stage profiles may be selectable by the user. In another embodiment, each of the previous hydraulic fracturing stage profiles may include two options, accept or amend.

The supervisory controller 124 may include instructions stored in the memory 202 which, when executed by the processor 204, may, in response to a selection to amend a previous hydraulic fracturing stage profile, communicate or send a request that the user amend the selected hydraulic fracturing stage profile. In such examples, the instructions, when executed by the processor 204, may communicate or send a data packet including text to include on the display 206 and a form or data fields filled in with the data from the selected hydraulic fracturing stage parameters. In other words, the form or data fields may appear the same as described above, but may be pre-filled with the data from the selected hydraulic fracturing stage profile. Any form or data field may be updated or remain as is. As described above, a save button may be included.

The supervisory controller 124 may include instructions stored in the memory 202 which, when executed by the processor 204, may prompt the user to accept the selected, new, or amended hydraulic fracturing stage profile as the current hydraulic stage profile for the current hydraulic stage profile. In such examples, the instructions, when executed by the processor 204) may communicate or send the prompt in response to an entry or amendment and save of a new hydraulic fracturing stage profile or amended selected hydraulic fracturing stage profile, respectively. In a further example, the instructions may communicate or send the prompt in response to a selection of a previous hydraulic fracturing stage profile.

The supervisory controller 124 may include instructions stored in the memory 202 which, when executed by the processor 204, may, in response to a reception of an acceptance of the selected, new, or amended hydraulic fracturing stage profile, communicate or send the current hydraulic fracturing stage profile (in other words, the current hydraulic fracturing stage parameters) to the backside equipment 120 for the current hydraulic fracturing stage. As noted above, the supervisory controller 124 may be in signal communication with the backside equipment 120. The connection between the supervisory controller 124 and backside equipment 120 may be a representational state transfer (REST or RESTful) interface, a Web Socket® interface, or some other transmission control protocol (TCP) or QUIC based interface. In such examples, the current hydraulic fracturing stage parameters may be sent from the supervisory controller 124 to the backside equipment 120 over hypertext transfer protocol (HTTP), hypertext transfer protocol secure (HTTPS), or other protocol.

After the supervisory controller 124 communicates or sends the current hydraulic fracturing stage parameters to the backside equipment 120 (blender unit 112, hydration unit 114, chemical additive unit 116, and conveyor 118) the supervisory controller 124 may wait for a confirmation of reception of the current hydraulic fracturing stage parameters. In response to a reception of the confirmation of reception of the current hydraulic fracturing stage parameters, the supervisory controller 124 may include instructions which, when executed by the processor 204, may determine a set of the hydraulic fracturing pumps 108 to be utilized based on the flow rate, pressure rate, maximum pressure, and hydraulic fracturing pumps 108 available for use.

In another embodiment, after the set of hydraulic fracturing pumps 108 are selected for the current hydraulic fracturing stage, the processor 204 of the supervisory controller 124 may execute instructions included in the memory 202 to determine whether the set of the hydraulic fracturing pumps 108 meet the pressure rate and/or maximum pressure of the current hydraulic fracturing stage profile. In another embodiment, the supervisory controller 124 may include instructions stored in the memory 202 which, when executed by the processor 204, may, in response to a determination that not all of the sets of the hydraulic fracturing pumps 108 meet the pressure rate and/or maximum pressure of the current hydraulic fracturing stage profile, notify the user which of the set of the hydraulic fracturing pumps 108 may not meet the criteria of the current hydraulic fracturing stage profile and determine if any of the set of the hydraulic fracturing pumps 108 meet a pressure rate utilization of between 50% to 98% (e.g., between 75% to 90%) of the current hydraulic fracturing stage profile. If one of the hydraulic fracturing pumps 108 do not meet a pressure rate utilization of between 50% to 98% (e.g., between 75% to 90%) of the current hydraulic fracturing stage profile, the processor 204 of the supervisory controller 124 may execute instructions to discount or remove the hydraulic fracturing pump from use in the current hydraulic fracturing stage. If one of the hydraulic fracturing pumps 108 do meet a pressure rate utilization of between 50% to 98% (e.g., between 75% to 90%) of the current hydraulic fracturing stage profile, the processor 204 of the supervisory controller 124 may execute instructions to send a prompt to the display 206 notifying a user that the user may accept use of the hydraulic fracturing pump. If a user chooses to utilize the hydraulic fracturing pump, the processor 204 of the supervisory controller 124 may execute instructions to prompt the user to enter an identification number to confirm an acceptance of the hydraulic fracturing pump.

In another embodiment, after the determination of whether to discount or remove any of the hydraulic fracturing pumps 108 due to pressure rate utilization, the processor 204 of the supervisory controller 124 may execute instructions included in the memory 202 to determine whether the set of the hydraulic fracturing pumps 108 meet the flow rate of the current hydraulic fracturing stage profile. In another embodiment, the supervisory controller 124 may include instructions stored in the memory 202 which, when executed by the processor 204, may, in response to a determination that not all of the sets of the hydraulic fracturing pumps 108 meet the flow rate of the current hydraulic fracturing stage profile, notify the user which of the set of the hydraulic fracturing pumps 108 may not meet the criteria of the current hydraulic fracturing stage profile and determine if any of the set of the hydraulic fracturing pumps 108 meet a flow rate at between 50% to 98% (e.g., between 75% to 90%) of crank RPM rating of the current hydraulic fracturing stage profile. If one of the hydraulic fracturing pumps 108 do not meet a flow rate at between 50% to 98% (e.g., between 75% to 90%) of crank RPM rating of the current hydraulic fracturing stage profile, the processor 204 of the supervisory controller 124 may execute instructions to discount or remove the hydraulic fracturing pump from use in the current hydraulic fracturing stage. If one of the hydraulic fracturing pumps 108 do meet a flow rate at between 50% to 98% (e.g., between 75% to 90%) of crank RPM rating of the current hydraulic fracturing stage profile, the processor 204 of the supervisory controller 124 may execute instructions to communicate or send a prompt to the display 206 notifying a user that the user may accept use of the hydraulic fracturing pump. If a user chooses to utilize the hydraulic fracturing pump, the processor 204 of the supervisory controller 124 may execute instructions to prompt the user to enter an identification number to confirm an acceptance of the hydraulic fracturing pump.

In another embodiment, after the determination of whether to discount or remove any of the hydraulic fracturing pumps 108 due to flow rate utilization, the processor 204 of the supervisory controller 124 may execute instructions included in the memory 202 to determine whether the set of the hydraulic fracturing pumps 108 meet a power utilization between 50% to 98% (e.g., between 75% to 80%) of maximum pressure for the current hydraulic fracturing stage profile. In another embodiment, the supervisory controller 124 may include instructions stored in the memory 202 which, when executed by the processor 204, may, in response to a determination that not all of the sets of the hydraulic fracturing pumps 108 meet the power utilization between 50% to 98% (e.g., between 75% to 80%) of maximum pressure for the current hydraulic fracturing stage profile, notify the user of the poor power utilization and prompt the operator to accept an increase in power utilization of the set of the hydraulic fracturing pumps 108. In response to an acceptance of the prompt to increase power utilization, the processor 204 may execute instructions to move one of the poor power utilization hydraulic fracturing pumps offline (in other words, remove a hydraulic fracturing pump from the set of the hydraulic fracturing pumps 108) at a time, until a desired power utilization is met. In another embodiment, the processor 204 may execute instructions to remove all of the poor power utilization hydraulic fracturing pumps offline or prompt the user to select which poor power utilization hydraulic fracturing pumps to move offline.

Figure 3:
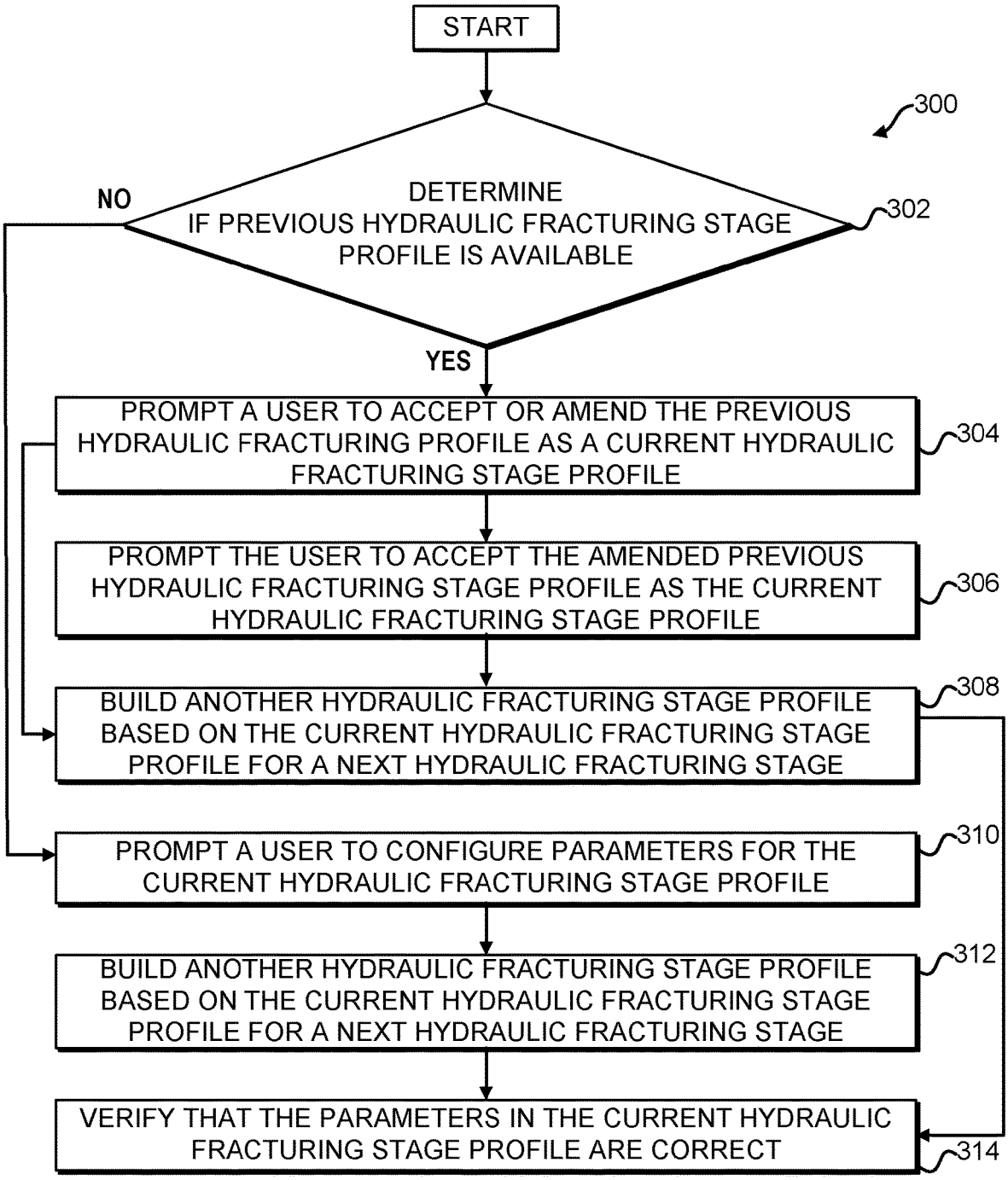
FIG. 3 is a flowchart of a method of enhanced operation of hydraulic fracturing equipment by use of hydraulic fracturing stage profiles, according to an embodiment of the disclosure.

FIG. 3 is a flowchart of example method 300 of utilizing and amending hydraulic fracturing stage profiles, according to an embodiment. The method is detailed with reference to the wellsite hydraulic fracturing system 100 and supervisory controller 124. Unless otherwise specified, the actions of method 300 may be completed within the supervisory controller 124. Specifically, method 300 may be included in one or more programs, protocols, or instructions loaded into the memory 202 of the supervisory controller 124 and executed on the processor 204. The order in which the operations are described is not intended to be construed as a limitation, and any number of the described blocks may be combined in any order and/or in parallel to implement the methods.

At block 302, the supervisory controller 124 may determine whether one or more previous hydraulic fracturing stage profiles 210 are available for use with the hydraulic fracturing equipment at the hydraulic fracturing wellsite. In an example, the supervisory controller 124 may search all storage attached or connected to the supervisory controller 124 to determine whether a previous hydraulic fracturing stage profile is available. In another embodiment, the supervisory controller 124 may determine whether a previous hydraulic fracturing stage is available for use after receiving a prompt from a user (e.g., when a user starts a process at a terminal or display 206 with an input device). In another embodiment, the supervisory controller 124 may perform the determination upon or without user intervention. For example, in response to a user opening or initiating an application, the supervisory controller 124 may initiate the determination. The supervisory controller 124, without intervention may initiate the determination after an event, e.g., the event being a completion of a previous hydraulic fracturing stage).

At block 304, supervisory controller 124 may prompt a user to accept or amend the previous hydraulic fracturing stage profile as a current hydraulic fracturing stage profile for a current hydraulic fracturing pumping stage, in response to the determination that previous hydraulic fracturing stage profiles are available for use. Stated another way, if hydraulic fracturing stage profiles are available, the supervisory controller 124 may prompt the user to accept or amend one of the available hydraulic fracturing stage profiles. In such examples, the supervisory controller 124 may list the available hydraulic fracturing stage profiles available for use. In such examples, a user may select one of the available hydraulic fracturing stage profiles for use in the next hydraulic fracturing stage. In another embodiment, supervisory controller 124 may prompt the user to select an available hydraulic fracturing stage profile while a hydraulic fracturing stage is occurring. In another embodiment, when a user selects a previous hydraulic fracturing stage to amend, the supervisory controller 124 may populate the display 206 or terminal with the hydraulic fracturing stage parameters of the selected hydraulic fracturing stage profile. The user may update or change any of the values populated on the display 206. In another embodiment, an interactive save field or button may populate the display 206 or terminal along with the hydraulic fracturing stage parameters of the selected hydraulic fracturing stage profile. After the user updates or changes the parameters, the user may save the changes or updates.

At block 306, in response to a reception of an amendment of a previous or available hydraulic fracturing stage, the supervisory controller 124 may prompt, at a display 206 or terminal, a user to accept the amended previous hydraulic fracturing stage profile as the current hydraulic fracturing stage profile. In other words, the amended previous hydraulic fracturing stage profile may be utilized, by the supervisory controller 124, as the current hydraulic fracturing stage profile for a current hydraulic fracturing stage.

At block 308, in response to either a selection or amendment of a previous hydraulic fracturing storage profile, the supervisory controller 124 may build another hydraulic fracturing stage profile based at least in part on the current hydraulic fracturing stage profile for a next hydraulic fracturing stage. The supervisory controller 124 may also base the new hydraulic fracturing stage profile on one or more previous hydraulic fracturing stage profiles, data from the hydraulic fracturing fleet, data from previous wellsites that the hydraulic fracturing fleet may have been utilized at, the hydraulic fracturing fleets alarm history, data from the hydraulic fracturing pump profiler, data from the controller 146 of the one or more hydraulic fracturing pumps 108, and/or other data relevant to a hydraulic fracturing stage, as will be understood by those skilled in the art. In other words, the supervisory controller 124 may populate the hydraulic fracturing stage parameters for the next hydraulic fracturing stage based on the data noted above. At a later time, the supervisory controller 124 may prompt a user to accept or amend the new hydraulic fracturing stage profile for the next hydraulic fracturing stage.

The supervisory controller 124 may also store the current hydraulic fracturing stage profile in memory 202 as another previous hydraulic fracturing stage profile or the new hydraulic fracturing stage profile (noted above) for the next hydraulic fracturing stage for use in association with the supervisory controller 124. In other words, the current hydraulic fracturing stage profile or the new hydraulic fracturing stage may be stored along with an indicator. In an example, the indicator may indicate which hydraulic fracturing stage the current hydraulic fracturing stage profile is to be used or utilized with. For example, a user may create, select, or amend n hydraulic fracturing stage profiles. Each of the n hydraulic fracturing stage profiles may be associated with a like numbered hydraulic fracturing stage (e.g., a n hydraulic fracturing stage profile may be associated with a n hydraulic fracturing stage, a n−1 hydraulic fracturing stage profile may be associated with a n−1 hydraulic fracturing stage, a n−2 hydraulic fracturing stage profile may be associated with a n−2 hydraulic fracturing stage, etc.). In an example, the indicator may be represented by an ID, number, letter, name, or some combination thereof. In another embodiment, a hydraulic fracturing stage may be saved as a JSON, B SON, XML, XLS, DB, or some other appropriate file type. In such examples, the name of the saved hydraulic fracturing stage profile may indicate the associated hydraulic fracturing stage.

At block 310, the supervisory controller 124 may prompt a user to configure hydraulic fracturing pumping stage parameters for the current hydraulic fracturing stage profile, in response to the determination that previous hydraulic fracturing stage profiles are not available for use. In such examples, the supervisory controller 124 may populate the display 206 or terminal with blank fields, including labels or texts to indicate the hydraulic fracturing stage parameters.

The supervisory controller 124 may store (as describe above) the current hydraulic fracturing stage profile in memory 202 as the previous hydraulic fracturing stage profile for use in association with the supervisory controller 124. In such examples, a previous hydraulic fracturing stage profile may not be available for use in either the supervisory controller's 124 memory 202 or at the computing device 208. In such examples, the supervisory controller 124 may store the current hydraulic fracturing stage profile as a previous hydraulic fracturing stage profile for potential use in a next or future hydraulic fracturing stage. As described above, the supervisory controller 124 may also build 312 a new hydraulic fracturing stage profile for the next hydraulic fracturing stage based on the current hydraulic fracturing stage profile, as well as other data, as will be understood by those in the art.

At block 314, the supervisory controller 124 may prompt the user at the terminal to verify that the hydraulic fracturing stage parameters in the current hydraulic fracturing stage profile are correct. In other words, in response to a selection, amendment, or entry of a new hydraulic fracturing stage profile, the supervisory controller 124 may send a prompt to the terminal requesting verification that the new hydraulic fracturing stage contains the correct hydraulic fracturing stage parameters for the current hydraulic fracturing stage. In such examples, the supervisory controller 124 may include the hydraulic fracturing stage parameters in the prompt for verification, thus allowing for the user to visually confirm that the hydraulic fracturing stage parameters are correct of the current hydraulic fracturing stage.

Figure 4A:
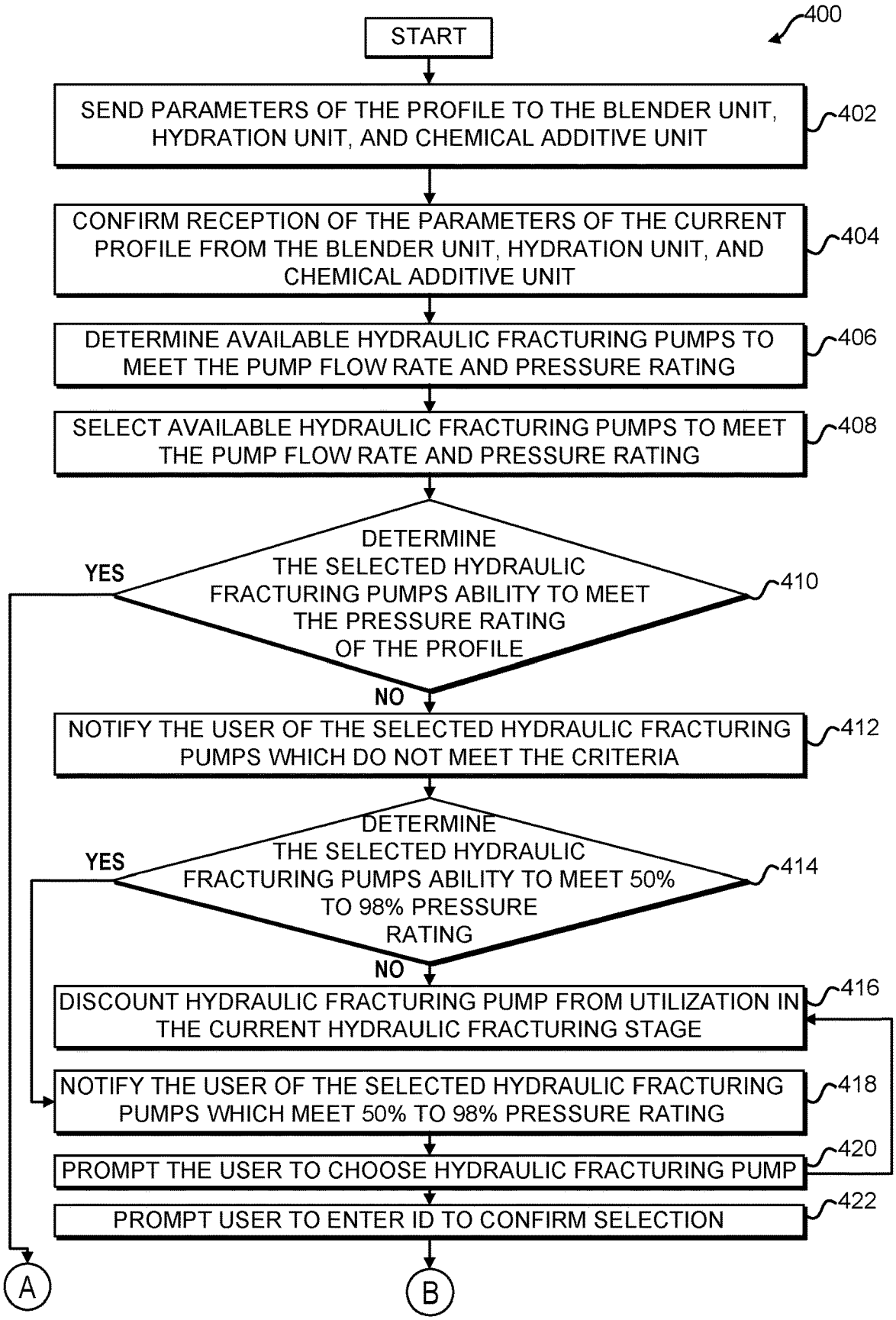
FIGS. 4A, 4B, and 4C are flowcharts of a method of enhanced operation of hydraulic fracturing equipment by use of hydraulic fracturing stage profiles, according to an embodiment of the disclosure.
Figure 4B:
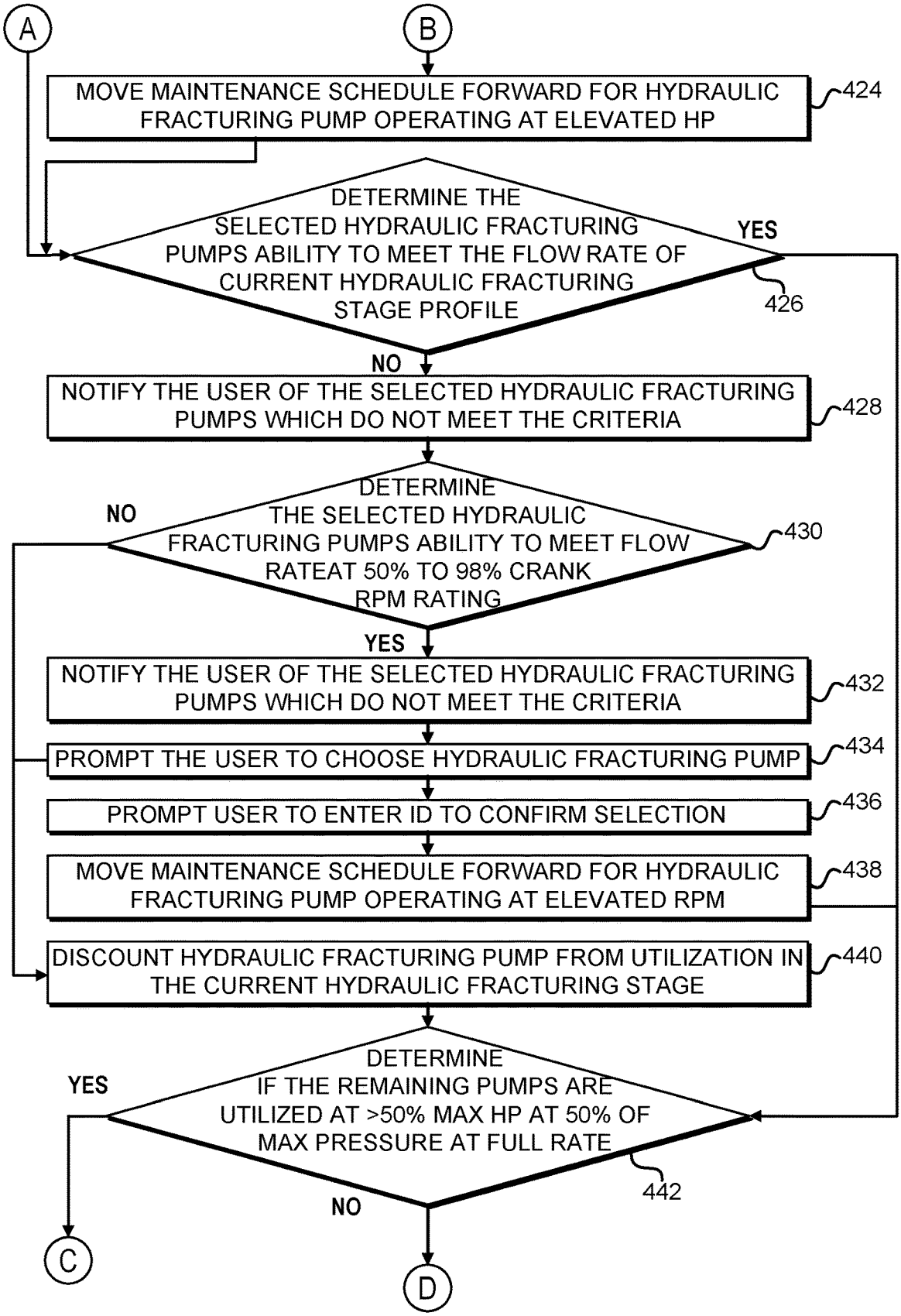
Figure 4C:
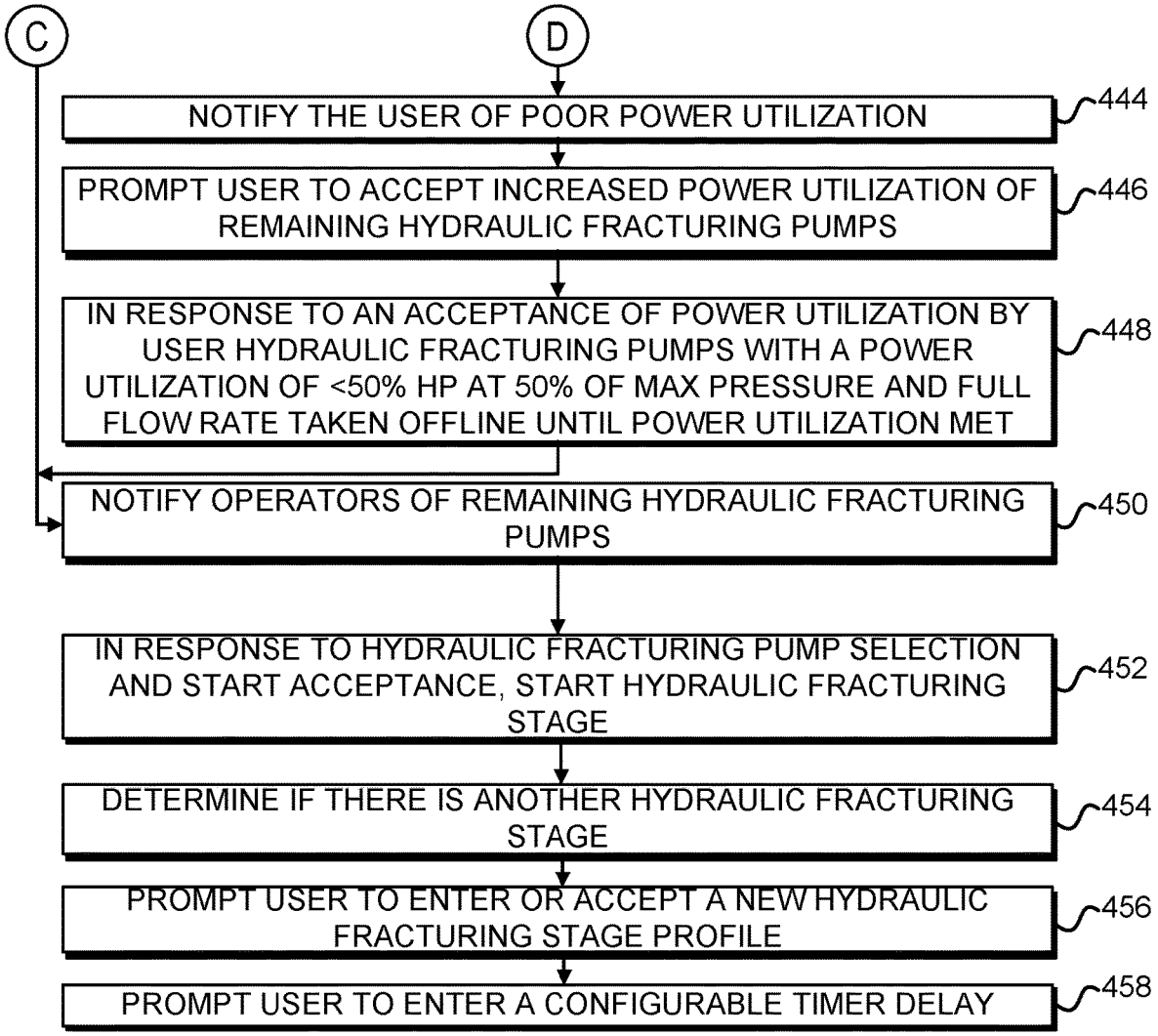

FIGS. 4A, 4B, and 4C are flowcharts of an example method 400 of utilizing and amending hydraulic fracturing stage profiles, according to an embodiment. The method is detailed with reference to the wellsite hydraulic fracturing system 100 and supervisory controller 124. Unless otherwise specified, the actions of method 400 may be completed within the supervisory controller 124. Specifically, method 400 may be included in one or more programs, protocols, or instructions loaded into the memory 202 of the supervisory controller 124 and executed on the processor 204. The order in which the operations are described is not intended to be construed as a limitation, and any number of the described blocks may be combined in any order and/or in parallel to implement the methods.

At block 402, in response to reception of a confirmation or verification that the current hydraulic fracturing stage parameters of the current hydraulic fracturing stage profile are correct, the supervisory controller 124 may communicate or send the hydraulic fracturing stage parameters of the current hydraulic fracturing stage profile to the blender unit 112, hydration unit 114, and chemical additive unit 116. At block 404, the supervisory controller 124 may confirm reception of the hydraulic fracturing pumping stage parameters of the current hydraulic fracturing stage profile from the blender unit 112, hydration unit 114, and chemical additive unit 116. In other words, before the hydraulic fracturing stage may continue, the supervisory controller 124 may wait for confirmation of reception of the parameters by the backside equipment 120. In another embodiment, the supervisory controller 124 may also communicate or send the parameters to the conveyor 118. In another embodiment, the supervisory controller 124 may communicate or send the parameters to the backside equipment 120 in a specific order. For example, the supervisory controller 124 may send the parameters to the blender unit 112 first. After confirmation of data reception by the blender unit 112 to the supervisory controller 124, the supervisory controller 124 may communicate or send the parameters to the hydration unit 114. After confirmation of data reception by the supervisory controller 124 from the hydration unit 114, the supervisory controller 124 may communicate or send data to the chemical additive unit 116. In another embodiment, the supervisory controller 124 may send the parameters to all the backside equipment 120 at once and wait for confirmation from all of the backside equipment 120 before moving on. In another embodiment, the confirmation may be sent automatically by each of the backside equipment 120. In another embodiment, a user or operator at each piece of the backside equipment 120 may verify that the parameters have been sent and are correct for the current hydraulic fracturing stage.

At block 406, the supervisory controller 124 may determine the available hydraulic fracturing pumps which meet the current hydraulic fracturing stage profiles pressure rate, maximum pressure, and flow rate. In another embodiment, the supervisory controller 124 may consider other factors in hydraulic fracturing pump availability. For example, the supervisory controller 124 may consider the hydraulic fracturing pumps' 108 maintenance schedules, current fuel levels for the internal combustion engines 107 powering the hydraulic fracturing pumps 108, which of the hydraulic fracturing pumps 108 are currently in use, and/or proximity of hydraulic fracturing pumps 108 to the wellhead 110. At block 408, based on the available hydraulic fracturing pumps, the supervisory controller 124 may select, from the available hydraulic fracturing pumps, the hydraulic fracturing pumps to meet the flow rate, pressure rate, and/or maximum pressure.

At block 410, the supervisory controller 124 may determine whether the selected hydraulic fracture pumps meet the profiles pressure rating. At block 412, if the selected hydraulic fracturing pumps do not meet the pressure rating, the supervisory controller 124 may notify a user, at the display 206, that a set of the selected hydraulic fracturing pumps do not meet the pressure rating. At block 414, after notifying the user, the supervisory controller 124 may determine whether the discounted hydraulic fracturing pumps may meet pressure utilizing 50% to 98% (e.g., 75% to 90%) of the profile pressure rating. At block 418, if the hydraulic fracturing pumps may meet 50% to 98% (e.g., 75% to 80%), then the supervisory controller 124 may notify the user. At block 420, after notifying the user, the supervisory controller 124 may send the user a confirmation on whether to use the discounted hydraulic fracturing pumps. In another embodiment, the supervisory controller 124 may send the notification and request to select the hydraulic fracturing pumps together (in other words, blocks 418 and 420 may performed simultaneously). At block 416, if the user decides to not use the hydraulic fracturing pumps or if the hydraulic fracturing pumps do not utilize at least 50% (e.g., at least 75%) of the profile pressure rating, the supervisory controller 124 may discount the hydraulic fracturing pumps. In other words, the supervisory controller 124 may remove the hydraulic fracturing pumps from the set of selected hydraulic fracturing pumps for the current hydraulic fracturing stage. At block 422, if the user decides to use the hydraulic fracturing pumps utilizing 50% to 98% (e.g., 75% to 90%) of the hydraulic fracturing stage profile pressure rating, the supervisory controller 124 may send a prompt requesting the user to enter in identification to confirm the selection. In an embodiment, the supervisory controller 124 may store the identification, a timestamp, the pumps selected, and/or some combination thereof at a local memory of the supervisory controller 124 or at a separate computing device 208. At block 424, the supervisory controller 124 may move the scheduled maintenance of the selected hydraulic fracturing pumps forward or to a sooner date and time.

At block 426, the supervisory controller 124 may determine whether the selected hydraulic fracture pumps meet the profiles flow rate. At block 428, if the selected hydraulic fracturing pumps do not meet the flow rate, the supervisory controller 124 may notify a user, at the display 206, that a set of the selected hydraulic fracturing pumps do not meet the flow rate. At block 430, after notifying the user, the supervisory controller 124 may calculate whether the discounted hydraulic fracturing pumps may meet flow rate utilizing 50% to 98% (e.g., 75% to 90%) of the crank RPM rating. At block 432, if the hydraulic fracturing pumps may meet 50% to 98% (e.g., 75% to 80%), then the supervisory controller 124 may notify the user. At block 434, after notifying the user, the supervisory controller 124 may send the user a confirmation on whether to use the discounted hydraulic fracturing pumps. In another embodiment, the supervisory controller 124 may send the notification and request to select the hydraulic fracturing pumps together or simultaneously. At block 440, if the user decides to not use the hydraulic fracturing pumps or if the hydraulic fracturing pumps do not meet flow rate utilizing at least 50% (e.g., at least 75%) of the crank RPM rating, the supervisory controller 124 may discount the hydraulic fracturing pumps. In other words, the supervisory controller 124 may remove the hydraulic fracturing pumps from the set of selected hydraulic fracturing pumps for the current hydraulic fracturing stage. At block 436, if the user decides to use the hydraulic fracturing pumps that meet flow rate utilizing 50% to 98% (e.g., 75% to 90%) of the crank RPM rating, the supervisory controller 124 may send a prompt requesting the user to enter in identification to confirm the selection. In an embodiment, the supervisory controller 124 may store the identification, a timestamp, the hydraulic fracturing pumps selected, and/or some combination thereof at a local memory of the supervisory controller 124 or at the separate computing device 208. At block 438, the supervisory controller 124 may move the scheduled maintenance of the selected hydraulic fracturing pumps forward or to a sooner date and time.

At block 442, the supervisory controller 124 may determine the hydraulic fracturing pumps power utilization. In other words, the supervisory controller 124 may determine whether all remaining hydraulic fracturing pumps being utilized for the current hydraulic fracturing stage operate at 50% to 90% maximum horsepower at 50% to 90% of maximum stage pressure at a full flow rate. At block 444, if the hydraulic fracturing pumps do not meet power utilization, the supervisory controller 124 may notify the user. At block 446, the supervisory controller 124 may prompt the user to accept an increase in power utilization. At block 448, if the user accepts the power optimization, each hydraulic fracturing pump with a poor power utilization may be taken offline serially or, in other words, one at a time until the desired power utilization it met. In another embodiment, the supervisory controller 124 may remove all hydraulic fracturing pumps not meeting power utilization.

At block 450, the supervisory controller 124 may notify the user which hydraulic fracturing pumps are to be utilized or are left for the current hydraulic fracturing stage. At block 452, after notifying the user, the supervisory controller 124 may prompt the user to confirm the hydraulic fracturing pump selection. In another embodiment, the supervisory controller 124 may communicate or send a list of the hydraulic fracturing pumps for the stage, as well as a prompt to confirm the selection. In response to a confirmation, the supervisory controller 124 may start the hydraulic fracturing stage. In another embodiment, a previous hydraulic fracturing stage may be occurring and in response to the confirmation, the supervisory controller 124 may prompt the user to enter, select, or amend another hydraulic fracturing stage profile for another hydraulic fracturing stage. At block 454, the supervisory controller 124 may determine whether there are other hydraulic fracturing stages. At block 456, the supervisory controller 124 may prompt the user to enter, select, or amend another hydraulic fracturing stage profile for further or other hydraulic fracturing stages, until all planned hydraulic fracturing stages include hydraulic fracturing stage parameters. At block 458, for further hydraulic fracturing stage profiles, the supervisory controller 124 may prompt the user to enter in a time delay. For example, when the current stage finishes, the next stage, while ready to start, may not start until after the specified time delay. The time delay may allow for a user or other personnel/operators to inspect the hydraulic fracturing equipment at the wellsite before the next stage begins. In another embodiment, rather than a time delay, the supervisory controller 124 may prompt the user to confirm the next stage before initiation.

Figure 5:
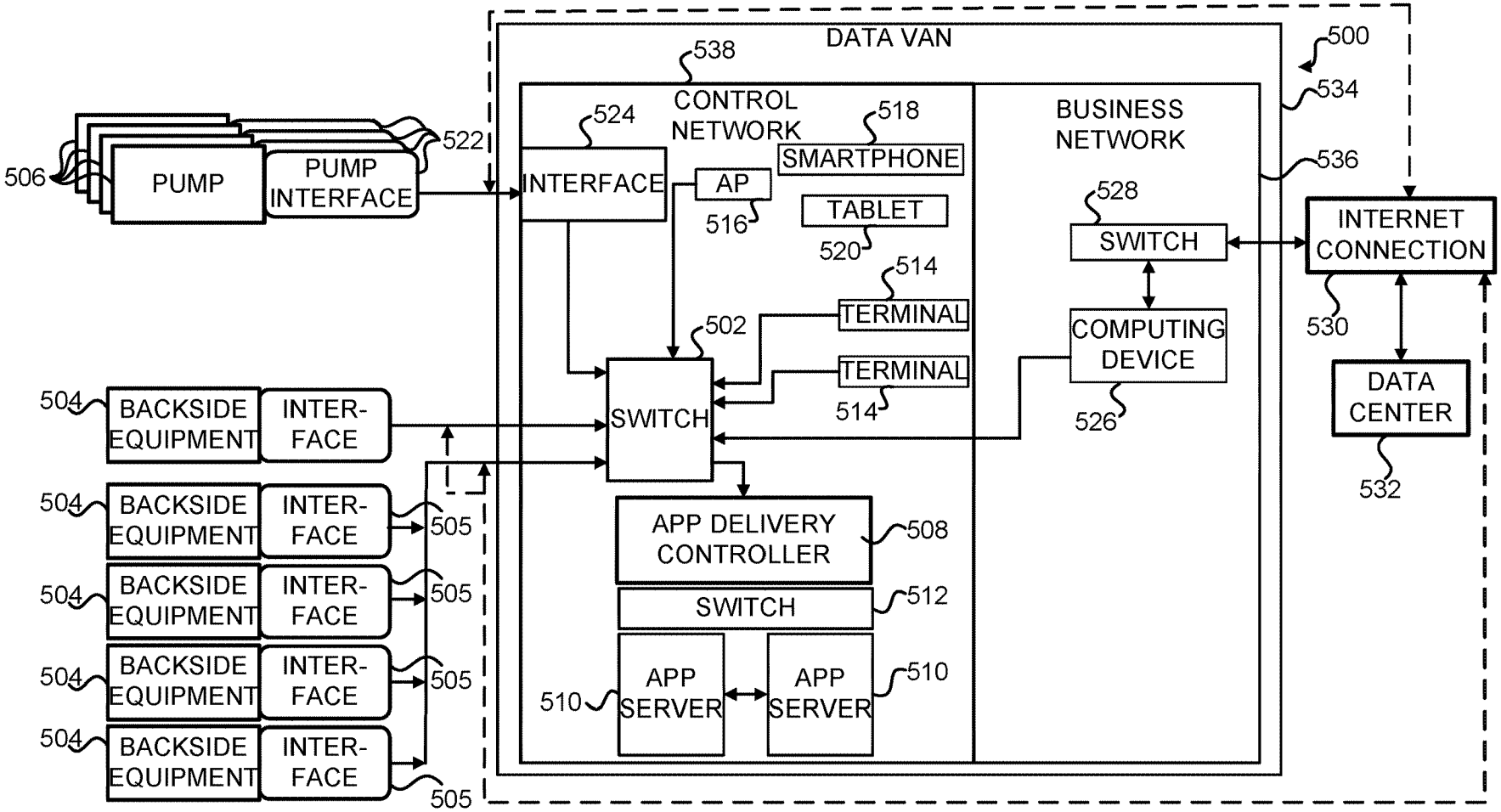
FIG. 5 is a block diagram of a wellsite hydraulic fracturing pumper system, according to an embodiment of the disclosure.

FIG. 5 is a block diagram of a wellsite hydraulic fracturing pumper system 500, according to an example. In an embodiment, the controller or supervisor may be included in a data van 534. In such an embodiment, the data van 534 may be separated into a control network 538 and business network 536. In another embodiment, the control network 538 may include the controller, as well as user displays (e.g., a user or operator terminal 514). The controller may include various electronic components. For example, the controller may include a switch (e.g., an Ethernet switch 502) to connect to the backside equipment 504 or backside equipment 504 controllers (e.g., via an interface 505 such as a REST, RESTful, or WebSocket® interface) and one or more hydraulic fracturing pumps 506 or the one or more hydraulic fracturing pumps 506 controllers to an application delivery controller 508. The application delivery controller 508 may connect to a server and backup or mirrored server (e.g., two connected and/or mirrored application servers 510) via another switch 512. In such examples, the controller may be considered the Ethernet switch 502, the application delivery controller 508, the switch 512, and the two connected and/or mirrored application servers 510. In another embodiment, the controller may be in signal communication with user or operator terminals 514. In another embodiment, the controller may connect to a wireless access point (AP) 516 or wireless router. In such examples, a user may connect to the controller via wireless signals. Further the user may connect to the controller via a smartphone 518 or tablet 520. In another embodiment, a hydraulic fracturing pump interface 522, disposed on a controller or component of each of the hydraulic fracturing pumps 506, may be in direct electrical communication with an intermediate interface 524. The hydraulic fracturing pump interface 522 may be a serial interface (e.g., a RS422 interface). In another embodiment, the hydraulic fracturing pump interface 522 may be a wireless interface. In other words, the hydraulic fracturing pump interface 522 may send data, via a wireless network, to the intermediate interface 524. The intermediate interface 524 may be in direct electrical communication or wireless communication with the controller (through the Ethernet switch 502).

As noted, the data van 534 may include a business network 536 or business unit. The business network 536 may include a computing device 526 to store the hydraulic fracturing stage profiles, as well as other wellsite data and analytics. The computing device 526 may be in signal communication with the controller. The computing device 526 may be a server. In another embodiment, the computing device 526 may be an edge server. In a further example, the computing device 526 may connect to a switch 528 to send, through an internet connection 530, data and/or analytics of the wellsite to a data center 532 for further analysis. Further, the hydraulic fracturing pumps 506 and backside equipment 504 may connect, through the internet connection 530, to the data center 532, thus providing real time data to the data center 532.

Figure 6:
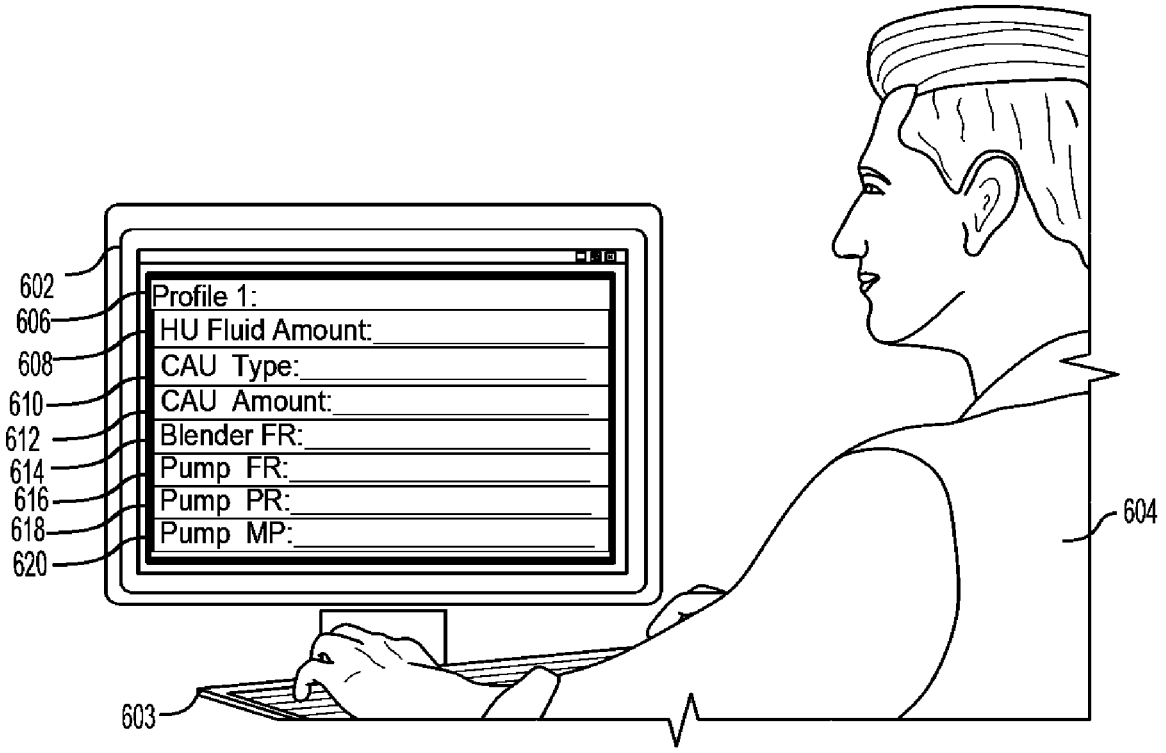
FIG. 6 is a schematic view of a display of a wellsite hydraulic fracturing system, according to an embodiment of the disclosure.
Figure 7:
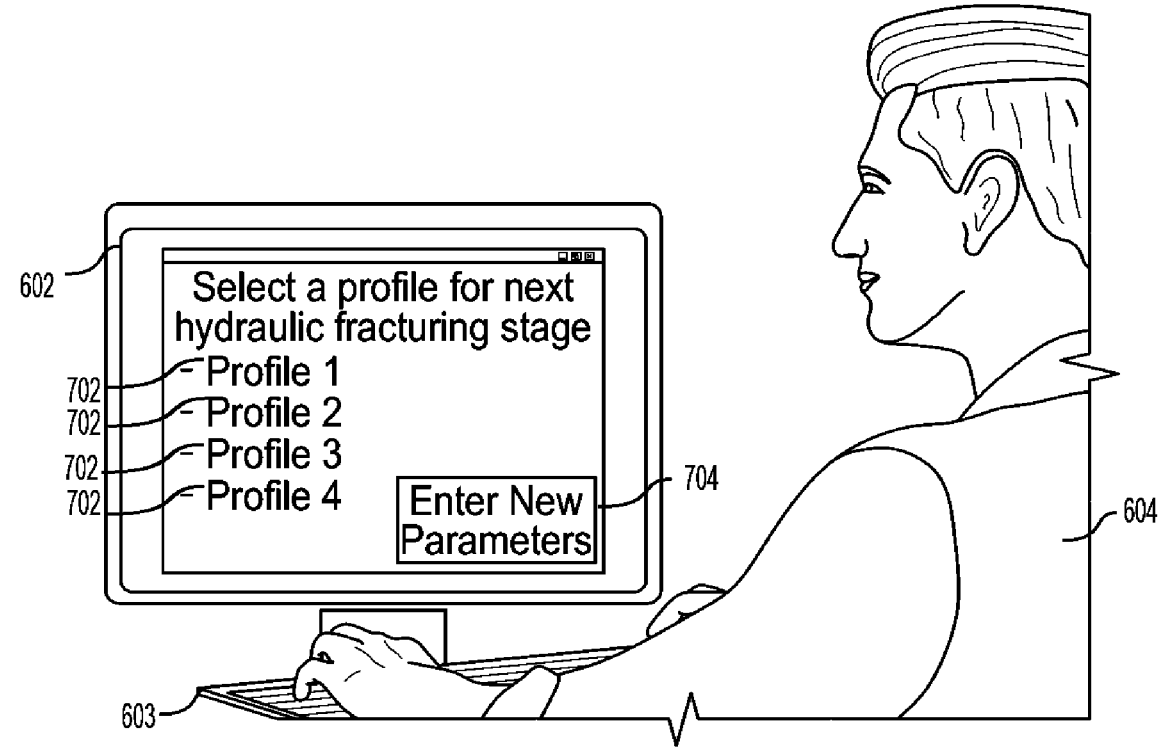
FIG. 7 is another schematic view of a display of a wellsite hydraulic fracturing system, according to an embodiment of the disclosure.
Figure 8:
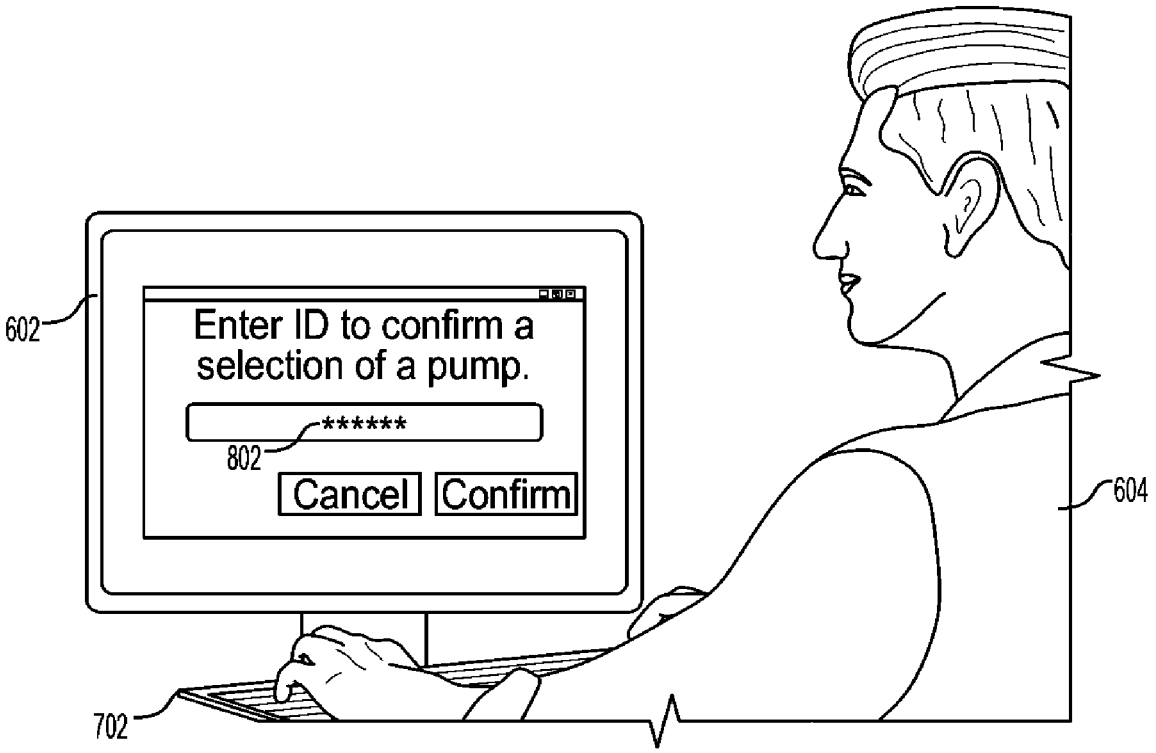
FIG. 8 is another schematic view of a display of a wellsite hydraulic fracturing system, according to an embodiment of the disclosure.

FIGS. 6, 7, and 8 are schematic views of a terminal 602, according to an embodiment. As noted, the terminal 602 or display may be in signal communication with a controller. Further, an input device 603 (e.g., a keyboard or touch-sensitive display) may be in signal communication with the controller as well, to allow a user 604 to enter data into the terminal 602. As such, the controller may send prompts or requests to the terminal 602. As shown, the controller may send a prompt for the user 604 to fill in or enter in data for a current hydraulic fracturing stage profile 606. In such examples, the current hydraulic fracturing stage profile 606 may include fields for the amount of liquid from the hydration unit 608, the amount of chemicals from the chemical additive unit 612, the type of chemicals from the chemical additive unit 610, the amount of proppant from the conveyor (not shown), the flow rate for the blender unit 614, the flow rate for the hydraulic fracturing pumps to be selected 616, the pressure rate for the hydraulic fracturing pumps to be selected 618, the maximum pressure of the hydraulic fracturing pumps to be selected 620, and/or other hydraulic fracturing stage parameters. In such examples, the user 604 may enter data into each field via the input device 603. In another embodiment, the controller may send a prompt for a user 604 to accept a hydraulic fracturing stage profile 702 for a next hydraulic fracturing stage 704. In such examples, the user 604 may select one of the hydraulic fracturing stage profiles 702, choose to amend one of the hydraulic fracturing stage profiles 702 after selecting one of the hydraulic fracturing stage profiles 702, or choose to enter in new hydraulic fracturing stage parameters 704. In response to a selection, a notification may be sent to the controller, including the option selected. In another embodiment, if a user 604 selects one of the hydraulic fracturing stage profiles 702, the controller may display a prompt to select the profile or amend the profile. In another embodiment, the controller may request that the user 604 enter in the users 604 employee identification (ID) 802 to select hydraulic fracturing pumps that do not meet the hydraulic fracturing stage profile criteria (e.g., the pressure rate, the maximum pressure, or the flow rate). In such an example, the controller may store, in response to entry of the user's employee ID 802, locally or to a computing device, the user's employee ID 802, a time stamp (in other words, when the hydraulic fracturing stage pump was selected), and/or the hydraulic fracturing pumps selected.

Figure 9:
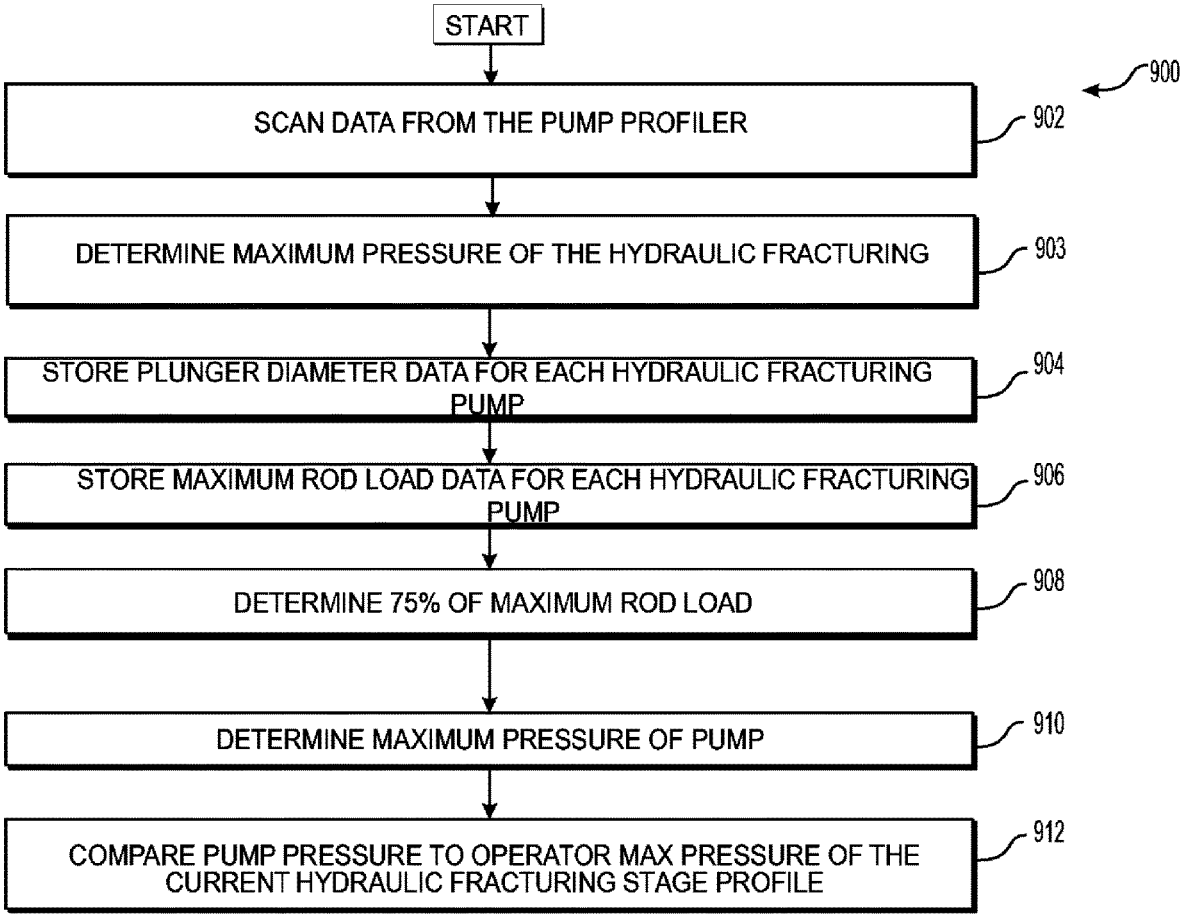
FIG. 9 is a flowchart of a method for determining hydraulic fracturing pump pressure in relation to a value in the hydraulic fracturing stage profile, according to an embodiment of the disclosure.
Figure 10:
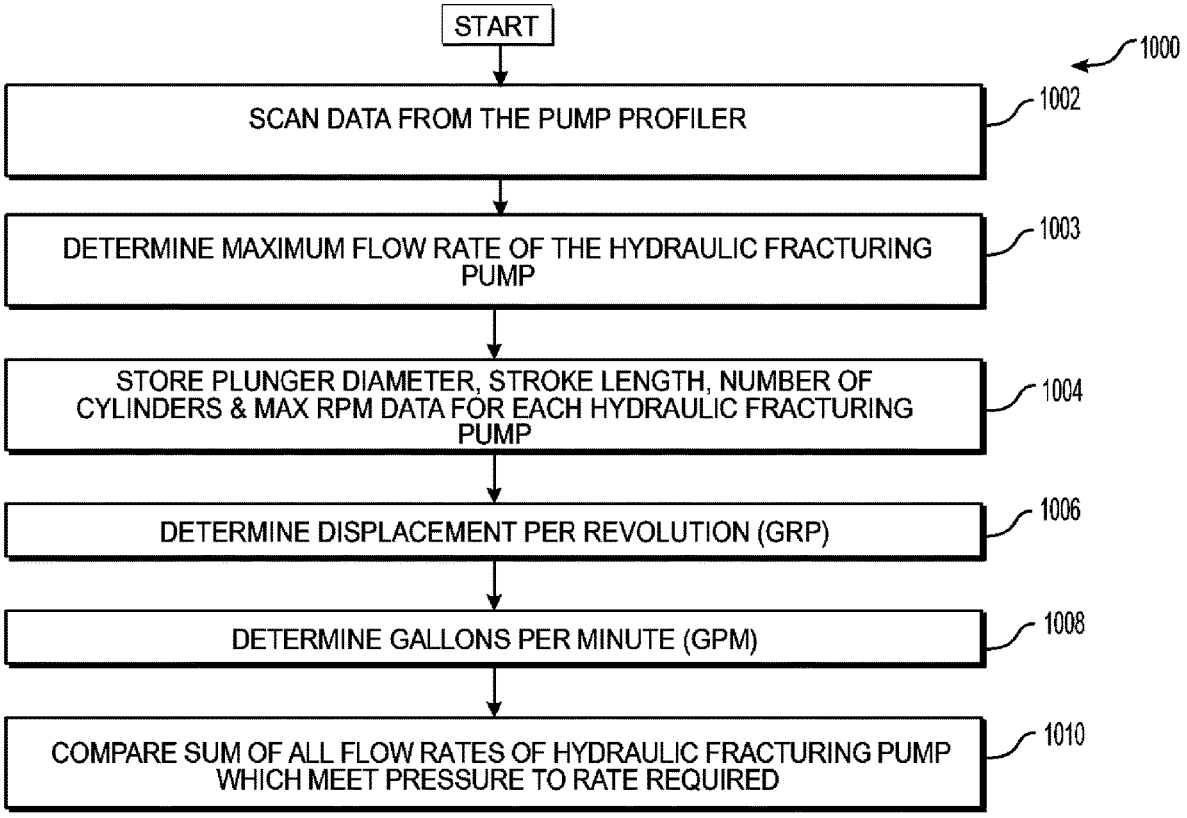
FIG. 10 is flowchart of a method for determining hydraulic fracturing pump flow rate in relation to a value in the hydraulic fracturing stage profile, according to an embodiment of the disclosure.

FIG. 9 is a flowchart of a method 900 for determining hydraulic fracturing pump pressure in relation to a value in the hydraulic fracturing stage profile, according to an embodiment. FIG. 10 is a flowchart of a method 1000 for determining hydraulic fracturing pump flow rate in relation to a value in the hydraulic fracturing stage profile, according to an embodiment. These methods are detailed with reference to the wellsite hydraulic fracturing system 100 and supervisory controller 124. Unless otherwise specified, the actions of method 900 and 1000 may be completed within the supervisory controller 124. Specifically, method 900 and 1000 may be included in one or more programs, protocols, or instructions loaded into the memory 202 of the supervisory controller 124 and executed on the processor 204. The order in which the operations are described is not intended to be construed as a limitation, and any number of the described blocks may be combined in any order and/or in parallel to implement the methods.

As noted above, the supervisory controller 124 may determine whether a hydraulic fracturing pumps pressure meets the pressure rate specified in the current hydraulic fracturing stage profile. At block 902, the supervisory controller 124 may scan a hydraulic fracturing pump's pump profiler, controller, or sensor to obtain or determine 903 the maximum pressure that the hydraulic fracturing pumps may meet. At block 904, the supervisory controller 124 may store the plunger diameter (PD) from the pump profiler. At block 906, the supervisory controller 124 may store the maximum rod load (RL) for each of the hydraulic fracturing pumps. At block 908, the controller may determine 75% of the maximum RL. At block 910, the supervisory controller 124, utilizing maximum RL, may determine the maximum pressure (PSI) of the hydraulic fracturing pump with the following equation:

$$RL/PD^2*0.7854=PSI$$

At block 912, the supervisory controller 124 may compare the determined pressure to the maximum pressure of the hydraulic fracturing stage profile. As noted above and in relation to method 400, the supervisory controller 124 may discount or remove the hydraulic fracturing pumps, which do not meet 50% to 90% of the pressure rating of the current hydraulic fracturing profile.

As noted above, the supervisory controller 124 may determine whether a hydraulic fracturing pumps flow rate meets the flow rate specified in the hydraulic fracturing stage profile. At block 1002, the supervisory controller 124 may scan a hydraulic fracturing pump's pump profiler, controller, or sensor to obtain or determine, at block 1003, the maximum flow rate that the hydraulic fracturing pump may pump. At block 1004, the controller may store the plunger diameter (PD), stroke length (SL), number of cylinders (NC), and/or maximum RPM for each hydraulic fracturing pump. At block 1006, the supervisory controller 124 may determine the displacement per revolution (GPR):

$$PD^2*0.7854*SL*NC/231=GPR$$

At block 1008, utilizing 75% of the maximum pump RPM rating, the supervisory controller 124 may determine gallons per minute (GPM) with the following equation:

$$GPR*RPM=GPM$$

In another embodiment, the supervisory controller 124 may convert the GPM to barrels per minute (BPM). At block 1010, the supervisory controller 124 may sum all flow rates of the hydraulic fracturing pumps that meet the maximum pressure and may compare the summed flow rate to the flow rate of the hydraulic fracturing stage profile. As noted above and in relation to method 400, the supervisory controller 124 may discount or remove the hydraulic fracturing pumps which do not meet the flow rate at 50% to 90% maximum HP at 50% to 90% maximum pressure at full flow rate of the current hydraulic fracturing profile.

References are made to block diagrams of systems, methods, apparatuses, and computer program products according to example embodiments. It will be understood that at least some of the blocks of the block diagrams, and combinations of blocks in the block diagrams, may be implemented at least partially by computer program instructions. These computer program instructions may be loaded onto a general purpose computer, special purpose computer, special purpose hardware-based computer, or other programmable data processing apparatus to produce a machine, such that the instructions which execute on the computer or other programmable data processing apparatus create means for implementing the functionality of at least some of the blocks of the block diagrams, or combinations of blocks in the block diagrams discussed.

These computer program instructions may also be stored in a non-transitory machine-readable memory that may direct a computer or other programmable data processing apparatus to function in a particular manner, such that the instructions stored in the machine-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide task, acts, actions, or operations for implementing the functions specified in the block or blocks.

One or more components of the systems and one or more elements of the methods described herein may be implemented through an application program running on an operating system of a computer. They may also be practiced with other computer system configurations, including handheld devices, multiprocessor systems, microprocessor-based or programmable consumer electronics, mini-computers, mainframe computers, and the like.

Application programs that are components of the systems and methods described herein may include routines, programs, components, data structures, etc. that may implement certain abstract data types and perform certain tasks or actions. In a distributed computing environment, the application program (in whole or in part) may be located in local memory or in other storage. In addition, or alternatively, the application program (in whole or in part) may be located in remote memory or in storage to allow for circumstances where tasks may be performed by remote processing devices linked through a communications network.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims.

This U.S. non-provisional patent application claims priority to and the benefit of, under 35 U.S.C. § 119(e), U.S. Provisional Application No. 62/705,332, filed Jun. 22, 2020, titled "METHODS AND SYSTEMS TO ENHANCE OPERATION OF HYDRAULIC FRACTURING EQUIPMENT AT A HYDRAULIC FRACTURING WELLSITE BY HYDRAULIC FRACTURING STAGE PROFILES," and U.S. Provisional Application No. 62/705,356, filed Jun. 23, 2020, titled "STAGE PROFILES FOR OPERATIONS OF HYDRAULIC SYSTEMS AND ASSOCIATED METHODS," the disclosures of both of which are incorporated herein by reference in their entirety.

In the drawings and specification, several embodiments of systems and methods of enhancing operation of hydraulic fracturing equipment at a hydraulic fracturing wellsite have been disclosed, and although specific terms are employed, the terms are used in a descriptive sense only and not for purposes of limitation. Embodiments of systems and methods have been described in considerable detail with specific reference to the illustrated embodiments. However, it will be apparent that various modifications and changes may be made within the spirit and scope of the embodiments of systems and methods as described in the foregoing specification, and such modifications and changes are to be considered equivalents and part of this disclosure.

What is claimed:

1. A wellsite hydraulic fracturing pumper system, the system comprising:

hydraulic fracturing pumps configured to provide a slurry to a wellhead in hydraulic fracturing pumping stages and when positioned at a hydrocarbon well site;

a blender configured to provide the slurry, the slurry including fluid, chemicals, and proppant, to the hydraulic fracturing pumps;

a hydration unit to provide fluid to the blender;

a chemical additive unit to provide chemicals to the blender;

a conveyor to provide proppant to the blender; and a controller to control the hydraulic fracturing pumps, blender, hydration unit, chemical additive unit, and conveyor, the controller positioned in signal communication with a terminal, a computing device, and sensors included on the hydraulic fracturing pumps, blender, hydration unit, chemical additive unit, and conveyor, the controller including a processor and a memory storing instructions, the instructions, when executed by the processor, to:

determine if hydraulic fracturing stage profiles are available for use in the hydraulic fracturing pumping stages;

in response to determination that the hydraulic fracturing stage profiles are not available for use, communicate a prompt at the terminal to enter hydraulic fracturing stage parameters for a current hydraulic fracturing stage profile and for a current hydraulic fracturing stage;

in response to a determination that the hydraulic fracturing stage profiles are available for use, communicate a prompt at the terminal to utilize one of the hydraulic fracturing stage profiles or to amend one of the hydraulic fracturing stage profiles for the current hydraulic fracturing stage profile; and in response to an entry or amendment of the hydraulic fracturing stage parameters for the current hydraulic fracturing stage profile at the terminal, store the current hydraulic fracturing stage profile to the computing device with an indicator to indicate that the current hydraulic fracturing stage profile is associated with the current hydraulic fracturing pumping stage, and communicate a prompt to the terminal requesting acceptance of the use of the current hydraulic fracturing stage profile for the current hydraulic fracturing stage.

2. The wellsite hydraulic fracturing system of claim 1, wherein the hydraulic fracturing stage parameters include:

an amount of fluid for the hydration unit to provide to the blender;

an amount and type of chemicals for the chemical additive unit to provide to the blender;

an amount and type of proppant for the conveyor to provide to the blender;

a flow rate of the slurry for the blender to indicate a rate of flow of the slurry to a set of hydraulic fracturing pumps;

a flow rate for the set of hydraulic fracturing pumps to indicate a rate of flow to the wellhead; and a pressure rating and maximum pressure for the set of hydraulic fracturing pumps; and wherein the controller further includes instructions stored on the memory, when executed by the processor, to:

in response to a reception of the acceptance of the use of the current hydraulic fracturing stage profile for the current hydraulic fracturing stage:

communicate the amount of fluid to be provided to the blender to a controller of the hydration unit;

communicate the amount and type of chemicals to the chemical additive unit;

communicate the amount and type of proppant to a controller of the conveyor; and communicate the flow rate of the slurry to a blender flow meter of the blender.

3. The wellsite hydraulic fracturing system of claim 1, wherein the controller further includes instructions stored on the memory, when executed by the processor, to:

in response to a confirmation from the controller of the hydration unit, the controller of the chemical additive unit, the controller of the conveyor, and the blender flow meter that the hydraulic fracturing pumping stage parameters are received by the blender, hydration unit, chemical additive unit, and conveyor:

determine the set of hydraulic fracturing pumps to be utilized based on the flow rate, pressure rate, and maximum pressure in the current hydraulic fracturing stage profile and on available hydraulic fracturing pumps in the wellsite hydraulic pumper system; and determine whether the set of hydraulic fracturing pumps meet the pressure rating and flow rate for the set of hydraulic fracturing pumps of the current hydraulic fracturing stage profile.

4. The wellsite hydraulic fracturing system of claim 1, wherein the controller further includes instructions stored on the memory, when executed by the processor, to:

in response to a determination that one or more hydraulic fracturing pumps of the set of hydraulic fracturing pumps do not meet the pressure rating of the current hydraulic fracturing stage profile:

determine if the one or more hydraulic fracturing pumps are operable between 75 percent to 90 percent of the pressure rating;

in response to a determination that the one or more hydraulic fracturing pumps are operable between 75 percent and 90 percent of the pressure rating, communicate a prompt to the terminal to accept the one or more hydraulic fracturing pumps for use in the first hydraulic fracturing pump stage;

in response to a denial of use of the one or more hydraulic fracturing pumps operable between 75 percent and 90 percent of the pressure rating, discount the one or more hydraulic fracturing pumps;

in response to a determination that the one or more hydraulic fracturing pumps are not operable between 75 percent and 90 percent of the pressure rating, discount the one or more hydraulic fracturing pumps; and in response to an acceptance of use of the one or more hydraulic fracturing pumps operable between 75 percent and 90 percent of the pressure rating, communicate a prompt requesting a user to enter identification to confirm selection of the one or more hydraulic fracturing pumps.

5. The wellsite hydraulic fracturing system of claim 1, wherein the controller further includes instructions stored on the memory, when executed by the processor, to:

in response to a determination that one or more hydraulic fracturing pumps of the set of hydraulic fracturing pumps do not meet the flow rate for the set of hydraulic fracturing pumps of the current hydraulic fracturing stage profile:

determine if the one or more hydraulic fracturing pumps are operable between 75 percent to 90 percent of the flow rate;

in response to a determination that the one or more hydraulic fracturing pumps are operable between 75 percent and 90 percent of the flow rate, communicate a prompt to the terminal to accept the one or more hydraulic fracturing pumps for use in the first hydraulic fracturing pump stage;

in response to a denial of use of the one or more hydraulic fracturing pumps operable between 75 percent and 90 percent of the flow rate, discount the one or more hydraulic fracturing pumps;

in response to a determination that the one or more hydraulic fracturing pumps are not operable between 75 percent and 90 percent of the flow rate, discount the one or more hydraulic fracturing pumps; and in response to an acceptance of use of the one or more hydraulic fracturing pumps operable between 75 percent and 90 percent of the pressure rating, communicate a prompt requesting a user to enter identification to confirm selection of the one or more hydraulic fracturing pumps.

6. The wellsite hydraulic fracturing system of claim 1, wherein the controller further includes instructions stored on the memory, when executed by the processor, to:

in response to a determination that the set of hydraulic fracturing pumps meet the pressure rating and flow rate of the current hydraulic fracturing stage profile:

determine a power utilization of the set of hydraulic fracturing pumps;

in response to a determination that one or more hydraulic fracturing pumps are utilized at 75 percent maximum HP at 80 percent of maximum stage pressure and at full flow rate, communicate a notification to the terminal of poor power utilization and a prompt to accept increased power utilization of the set of hydraulic fracturing pumps; and in response to an acceptance of the increased power utilization, move one of the one or more hydraulic fracturing pumps with poor power utilization offline at a time until the set of hydraulic fracturing pumps is not a poor power utilization state.

7. The wellsite hydraulic fracturing system of claim 1, wherein the controller further includes instructions stored on the memory, when executed by the processor, to:

in response to a determination that the set of hydraulic fracturing pumps are not exhibiting poor power utilization:

communicate a notification and request for confirmation of the set of hydraulic fracturing pumps to be utilized; and in response to a reception of the confirmation of the set of hydraulic fracturing pumps to be utilized, start the current hydraulic fracturing stage.

8. The wellsite hydraulic fracturing system of claim 1, wherein the controller further includes instructions stored on the memory, when executed by the processor, to:

in response to a start of the current hydraulic fracturing stage, determine if further hydraulic fracturing stages are to occur; and in response to a determination that further hydraulic fracturing stages are to occur, communicate a prompt to the terminal to utilize or amend one of the hydraulic fracturing stage profiles or the current hydraulic fracturing stage profile for a next hydraulic fracturing stage, wherein the prompt is communicated during execution of the current hydraulic fracturing stage.

9. The wellsite hydraulic fracturing system of claim 1, wherein the amended current hydraulic fracturing profile includes a time delay, the time delay to indicate when the current hydraulic fracturing stage begins.

10. The wellsite hydraulic fracturing system of claim 1, wherein availability for use of the hydraulic fracturing stage profiles is based on maintenance data associated with the hydraulic fracturing pumps.

11. The wellsite hydraulic fracturing system of claim 1, wherein availability for use of the hydraulic fracturing stage profiles is based on events associated with the hydraulic fracturing pumps.

12. A controller for a hydraulic fracturing pumper system, the controller comprising:

a terminal input/output in signal communication with a terminal such that the controller is configured to:

in response to a determination that no hydraulic fracturing stage profiles are available for use, provide a prompt to the terminal to enter data for a hydraulic fracturing stage of a plurality of hydraulic fracturing stages into a first hydraulic fracturing stage profile;

receive the first hydraulic fracturing stage profile from the terminal input/output;

in response to a determination that hydraulic fracturing stage profiles are available for use, provide a prompt to the terminal requesting utilization or amendment of one of the hydraulic fracturing stage profiles for another hydraulic fracturing stage of the plurality of hydraulic fracturing stages;

receive acceptance of the use of one of the hydraulic fracturing stage profiles for the another hydraulic fracturing stage;

receive an amended hydraulic fracturing stage profile of the hydraulic fracturing stage profiles for the another hydraulic fracturing stage;

a server input/output in signal communication with a server such that each hydraulic fracturing stage profile, including indicators of associated hydraulic fracturing stages, are communicated between the controller and the server; and a first control output in signal communication with hydraulic fracturing pumps such that the controller provides pump control signals based on a stage of the plurality of hydraulic fracturing stages and an associated hydraulic fracturing stage profile.

13. The controller according to claim 12, further comprising:

a second output in signal communication with a blender to provide blender control signals based on the stage of the plurality of hydraulic fracturing stages and the associated hydraulic fracturing stage profile;

a third output in signal communication with a chemical additive unit to provide chemical additive unit control signals based on the stage of the plurality of hydraulic fracturing stages and the associated hydraulic fracturing stage profile; and a fourth output in signal communication with a hydration unit to provide hydration unit control signals based on the stage of the plurality of hydraulic fracturing stages and the associated hydraulic fracturing stage profile.

14. The controller according to claim 12, wherein a time delay is added to the amended profile, the time delay to indicate a start time of a next hydraulic fracturing stage after completion of a prior hydraulic fracturing stage.

15. The controller according to claim 12, wherein the controller determines hydraulic fracturing stage profiles available for use based on hydraulic fracturing equipment at a current wellsite and hydraulic fracturing equipment utilized for previous hydraulic fracturing stage profiles.

16. The controller according to claim 15, wherein the controller determines hydraulic fracturing stage profiles available for use further based on geological features at a current wellsite and geological features for previous hydraulic fracturing stage profiles.

17. The controller according to claim 15, wherein the controller determines hydraulic fracturing stage profiles available for use further based on maintenance data associated with the hydraulic fracturing equipment at the current wellsite.

18. The controller according to claim 15, wherein the controller determines hydraulic fracturing stage profiles available for use further based on events associated with the hydraulic fracturing equipment at the current wellsite.

* * * * *